US011975250B1

(12) United States Patent
Gowan et al.

(10) Patent No.: US 11,975,250 B1
(45) Date of Patent: May 7, 2024

(54) UNITARY LACROSSE STICK AND METHOD FOR MAKING

(71) Applicant: Wm. T. Burnett IP, LLC, Baltimore, MD (US)

(72) Inventors: Patrick Gowan, Columbia, MD (US); Thomas Acchione, Lutherville-Timonium, MD (US); Austin Scott Brown, Glen Rock, PA (US)

(73) Assignee: Wm. T. Burnett IP, LLC, Baltimore, MD (US)

( * ) Notice: Subject to any disclaimer, the term of this patent is extended or adjusted under 35 U.S.C. 154(b) by 98 days.

(21) Appl. No.: 17/241,824

(22) Filed: Apr. 27, 2021

Related U.S. Application Data

(60) Provisional application No. 63/017,715, filed on Apr. 30, 2020.

(51) Int. Cl.
*A63B 59/20* (2015.01)
*A63B 60/08* (2015.01)
*A63B 102/14* (2015.01)

(52) U.S. Cl.
CPC ..... *A63B 59/20* (2015.10); *A63B 60/08* (2015.10); *A63B 2102/14* (2015.10)

(58) Field of Classification Search
CPC ..... A63B 59/20; A63B 2102/14; A63B 60/08; A63B 2209/00; A63B 60/50
See application file for complete search history.

(56) References Cited

U.S. PATENT DOCUMENTS 1,937,787 A * 12/1933 Robinson ..... A63B 49/03 473/545
2,067,726 A * 1/1937 Ohlendorf ..... C07D 409/04 534/771
3,507,495 A 4/1970 Tucker et al.
(Continued)

OTHER PUBLICATIONS

NCAA Men's Lacrosse 2019 and 2020 Rules, Nov. 5, 2019 (102 pp), The National Collegiate Athletic Association, Indianapolis, Indiana. Retrieved from Internet: <http://www.ncaapublications.com/productdownloads/LC20_20191111.pdf>.
(Continued)

*Primary Examiner* — John E Simms, Jr.
*Assistant Examiner* — Amir A Klayman
(74) *Attorney, Agent, or Firm* — Plumsea Law Group, LLC

(57) ABSTRACT

Embodiments provide a lacrosse stick having a continuous juncture-handle portion and a flexible head portion molded to the juncture-handle portion, and a method for making the lacrosse stick. The juncture-handle portion may include first and second fork members extending from a throat member in a forward direction, a handle portion extending from the throat member in a rearward direction, and a first tab reinforcing member extending from the handle portion, through the throat member, and to the first fork member, and defining a first tab protruding beyond a distal forward end of the first fork member. The throat member, first and second fork members, and handle portion may be integrally formed of a first composite layup material, with the first tab reinforcing member formed of a stiffer second composite layup material. The head portion may include a first sidewall portion molded over the first tab reinforcing member.

19 Claims, 34 Drawing Sheets

(56) References Cited

U.S. PATENT DOCUMENTS 4,034,984 A 7/1977 Crawford et al.
4,220,335 A * 9/1980 Nobbs ..... A63B 60/00 473/539
4,340,226 A * 7/1982 Haines ..... A63B 49/10 264/250
RE31,419 E * 10/1983 Frolow ..... A63B 49/02 473/522
4,534,564 A * 8/1985 Yamada ..... A63B 53/04 473/345
4,725,059 A * 2/1988 Du Gardin ..... A63B 60/00 273/DIG. 7
4,915,382 A 4/1990 Madsen
5,007,652 A * 4/1991 Tucker ..... A63B 59/20 473/513
5,310,516 A * 5/1994 Shen ..... A63B 49/11 264/258
5,421,574 A * 6/1995 Yamagishi ..... A63B 60/54 473/282
5,464,210 A * 11/1995 Davis ..... A63B 49/022 473/549
5,566,947 A 10/1996 Tucker et al.
5,685,791 A 11/1997 Feeney
6,910,976 B2 6/2005 Tucker, Sr.
6,949,037 B2 * 9/2005 Enos ..... A63B 59/20 403/6
7,214,150 B2 * 5/2007 Filice ..... A63B 59/20 D21/724
7,282,000 B2 * 10/2007 Brine, III ..... A63B 60/06 D21/724
7,491,141 B1 * 2/2009 Tucker, Sr. ..... A63B 49/14 D21/724
7,736,251 B2 6/2010 Rogers et al.
7,749,112 B2 7/2010 Hayden et al.
8,029,390 B2 * 10/2011 Winningham ..... A63B 59/20 D21/724
8,282,512 B1 * 10/2012 Winningham ..... A63B 59/20 D21/724
10,898,779 B1 * 1/2021 Son ..... A63B 69/36211
2004/0002398 A1 * 1/2004 Morrow ..... A63B 59/20 473/513
2004/0072637 A1 4/2004 Morrow et al.
2005/0153799 A1 * 7/2005 Rigoli ..... A63B 59/20 473/513
2005/0215359 A1 * 9/2005 Gait ..... A63B 60/00 473/513
2006/0052187 A1 * 3/2006 Pai ..... A63B 60/54 473/546
2006/0160640 A1 * 7/2006 Rettberg ..... A63B 60/00 473/513
2007/0270254 A1 * 11/2007 Morrow ..... A63B 59/20 473/513
2007/0270255 A1 * 11/2007 Morrow ..... A63B 59/20 473/513
2008/0026883 A1 * 1/2008 MacNeil ..... A63B 59/20 473/513
2008/0026884 A1 * 1/2008 Morrow ..... A63B 59/20 29/433
2009/0149283 A1 * 6/2009 Garcia ..... A63B 60/00 473/563
2010/0068446 A1 * 3/2010 McGuire ..... B32B 27/08 264/279
2012/0071280 A1 3/2012 Copeland et al.
2013/0130830 A1 * 5/2013 Boyd ..... A63B 53/0466 29/527.1
2013/0237340 A1 * 9/2013 Mine ..... A63B 53/02 473/309
2014/0239531 A1 * 8/2014 Jiansheng ..... B29C 44/16 264/46.4
2014/0349789 A1 * 11/2014 Szurley ..... B32B 37/185 156/222
2015/0018136 A1 * 1/2015 Goldstein ..... B33Y 80/00 264/308
2015/0343277 A1 * 12/2015 Franklin ..... A63B 53/06 473/349
2019/0054668 A1 * 2/2019 Avnery ..... A63B 59/70
2021/0023413 A1 * 1/2021 Nurge ..... A63B 21/4034

OTHER PUBLICATIONS

NCAA Men's Lacrosse 2021 and 2022 Rules Book, Oct. 2020 (111 pp), The National Collegiate Athletic 2 Association, Indianapolis, Indiana.

* cited by examiner

Table 1: Commingled Fiber Embodiment Comparison

| Property | PA6 (ST801) Lacrosse Head Material | Epoxy Resin Juncture-Handle Portion | PA6 (Ultramid B27) Juncture-Handle Portion |
|---|---|---|---|
| **Base Polymer** | **PA6** | **Epoxide** | **PA6** |
| Density (g/cm) | 1.08 | 1.02 | 1.13 |
| Melt Point (C) | 263 | 150 | 220 |
| Tensile Modulus (MPa) Dry | 2000 | 3102 | 3000 |
| Tensile Strain (%) Dry | 32 | 2.5 | 5 |
| Tensile Strain (%) Cond | 50 | 5 (estimated) | 20 |
| Charpy Impact, notched, Dry | 80 | | 8 |
| Charpy Impact, notched, Conditioned | 115 | | 80 |

*FIG. 17*

TABLE 2: STIFFNESS TEST RESULTS

| LACROSSE HEAD | CONSTRUCTION | CONDITION | AVG. DISPLACEMENT @ 10 POUND-FORCE (IN) |
|---|---|---|---|
| HARROW HEMI (FULL COMPOSITE) | FULL COMPOSITE | AMBIENT | 0.153 |
| HARROW HEMI-CUDA (FULL COMPOSITE) | FULL COMPOSITE | AMBIENT | 0.203 |
| EMBODIMENT SAMPLE #1 | PLASTIC/COMPOSITE HYBRID DESIGN | AMBIENT | 1.293 |
| EMBODIMENT SAMPLE #2 | PLASTIC/COMPOSITE HYBRID DESIGN | AMBIENT | 1.234 |
| STX SURGEON 700 | PLASTIC ONLY HEAD | 24HR SATURATED IN WATER | 1.375 |
| *AVERAGE OF 3 DATA POINTS FROM SAME HEAD/STICK | | | |

PHOTOGRAPH 1: EMBODIMENT SAMPLE #1 SETUP

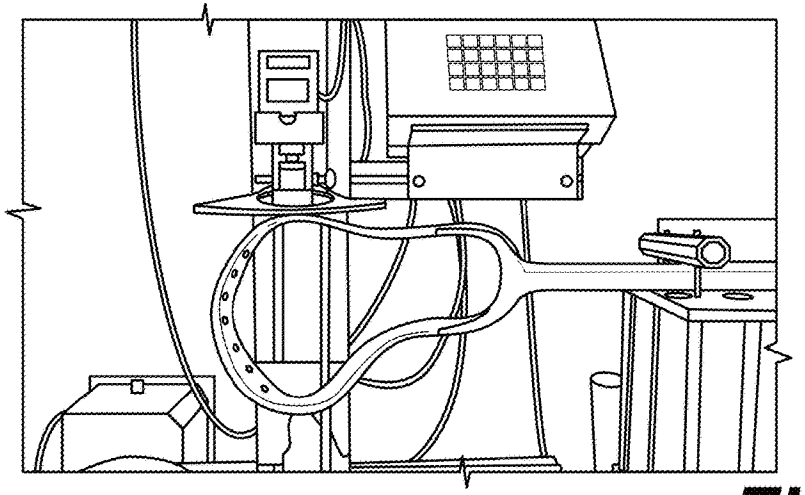

PHOTOGRAPH 2: HARROW HEMI SETUP

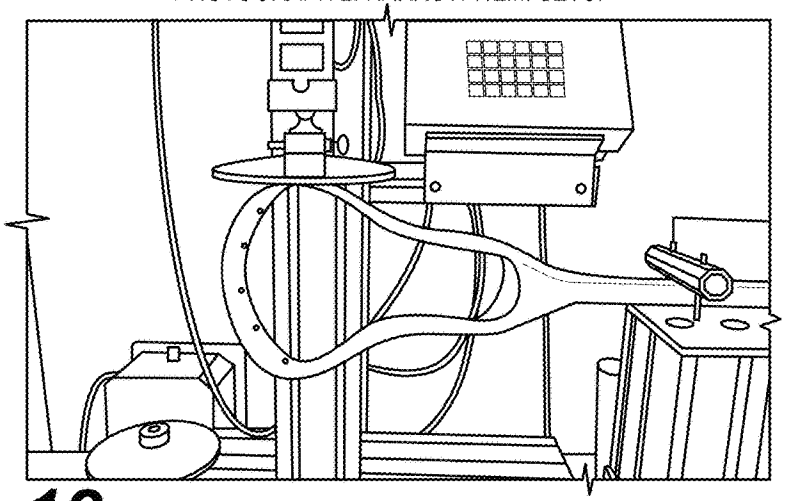

FIG. 18

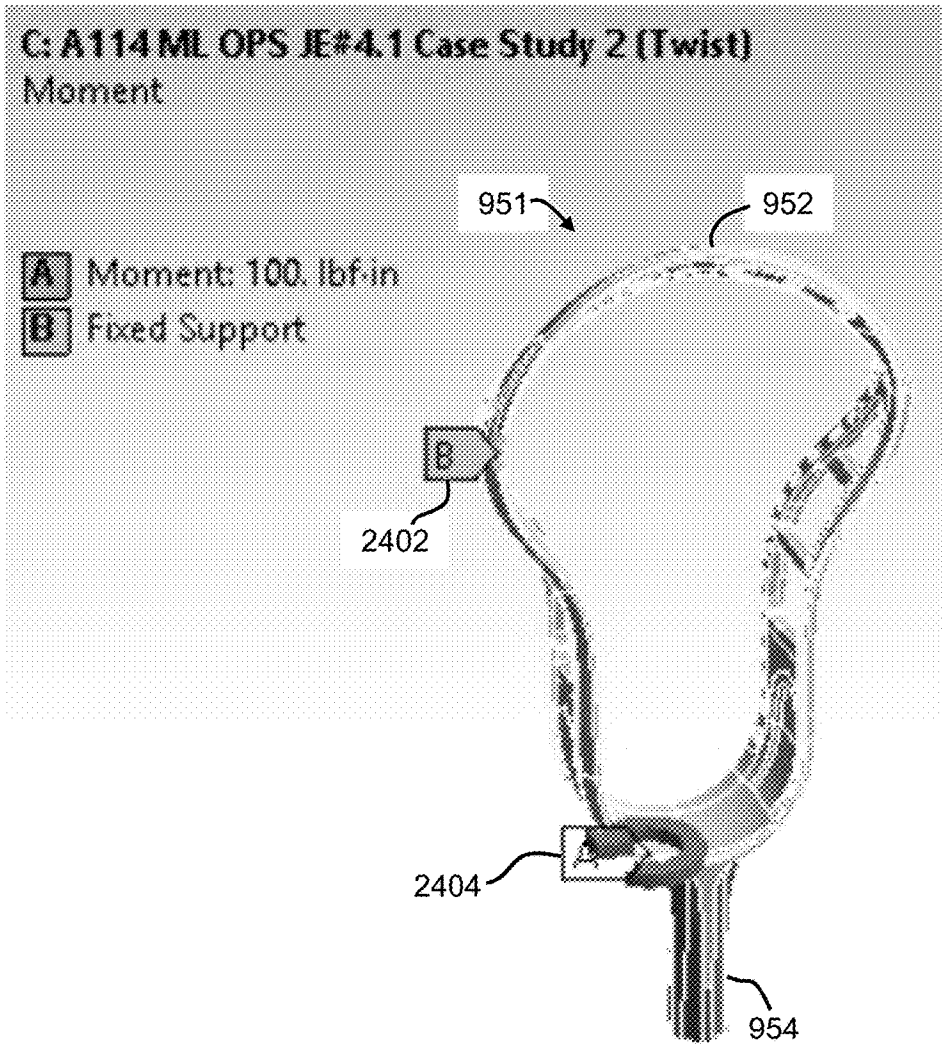
FIG. 24.1

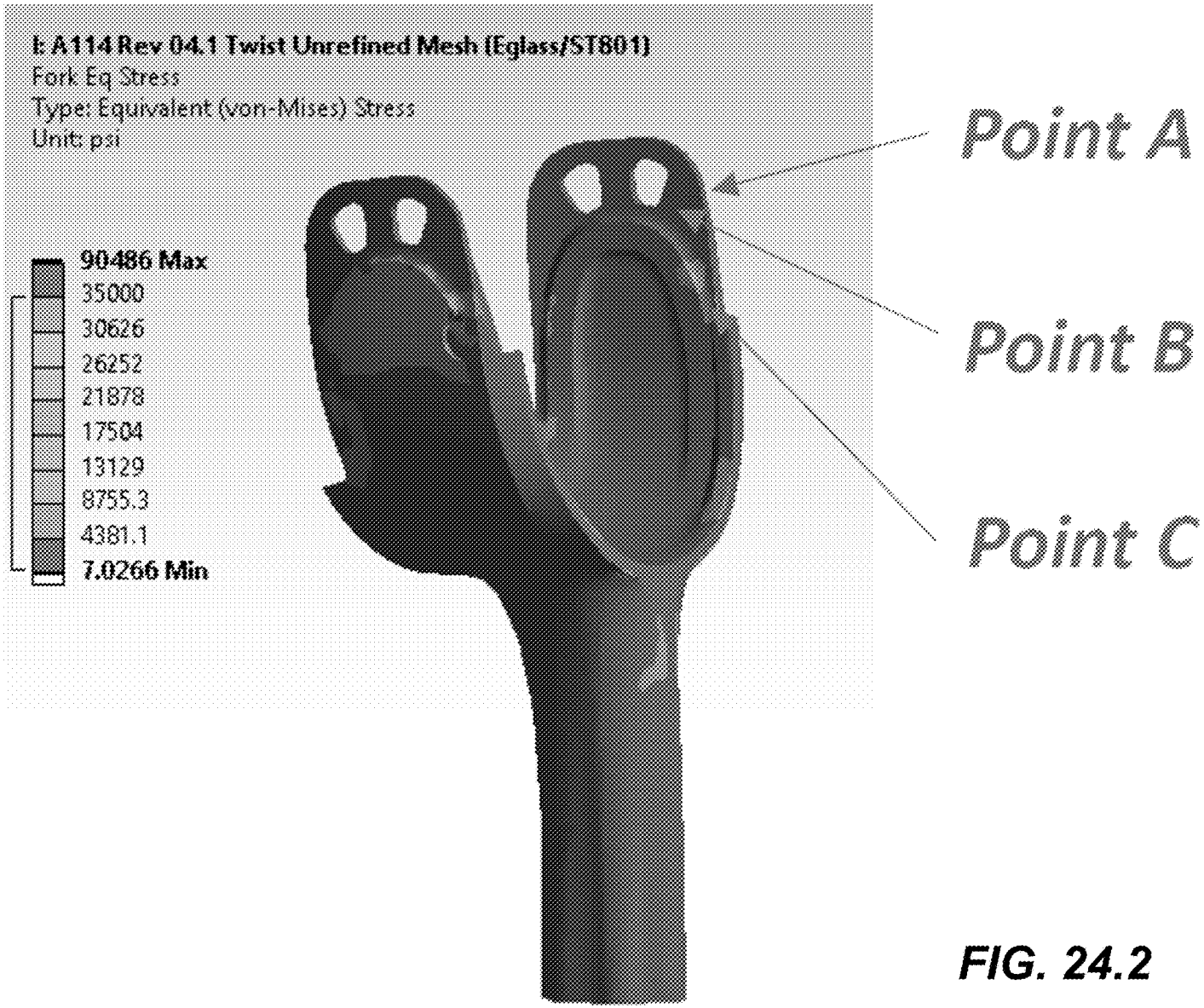
FIG. 24.2

UNITARY LACROSSE STICK AND METHOD FOR MAKING

CROSS-REFERENCE TO RELATED APPLICATION

This application claims the benefit of U.S. Provisional Application No. 63/017,715, filed Apr. 30, 2020, which is herein incorporated by reference in its entirety.

BACKGROUND

Field

The present embodiments relate generally to lacrosse equipment, and more particularly, to a unitary lacrosse stick having a continuous juncture-handle portion and a flexible head portion molded to the juncture-handle portion, and a method for making the lacrosse stick.

Background

Lacrosse players favor lacrosse sticks that provide control in catching, throwing, and cradling a lacrosse ball. Lacrosse stick design elements that impact such control include weight, balance, and hand-placement. Lacrosse players typically prefer lightweight sticks, with a balance that is suitable for a particular style of play, and with structural features that accommodate a hand placement desired for optimal ball control.

SUMMARY

Embodiments provide a lacrosse stick having a continuous juncture-handle portion and a flexible head portion molded to the juncture-handle portion, and a method for making the lacrosse stick. The continuous juncture-handle portion and the flexible head portion may form a unitary lacrosse stick that accommodates a desired weight, balance, and hand-placement. Embodiments provide a unitary lacrosse stick comprised of a juncture-handle portion and a head portion made of different materials, in which the different materials and components are effectively bound together in a manner that withstands the rigors of lacrosse at all levels of play, providing enhanced performance and durability compared to conventional approaches to joining lacrosse head components.

An embodiment provides a lacrosse stick having a juncture-handle portion and a head portion. The juncture-handle portion may include a throat member, a first fork member extending from the throat member in a forward direction, a second fork member extending from the throat member in the forward direction, a handle portion extending from the throat member in a rearward direction, and a first tab reinforcing member extending from the handle portion, through the throat member, and to the first fork member, and defining a first tab protruding beyond a distal forward end of the first fork member. The throat member, the first fork member, the second fork member, and the handle portion may be integrally formed of a first composite layup material. The first tab reinforcing member may be formed of a second composite layup material that is stiffer than the first composite layup material. The head portion may be made of a molded material and may include a first sidewall portion molded over the first tab reinforcing member and extending from the first fork member in the forward direction, a second sidewall portion extending from the second fork member in the forward direction, and a transverse wall portion connecting the first sidewall portion and the second sidewall portion opposite to the juncture-handle portion. The head portion may be more flexible than the juncture-handle portion.

In another aspect, the first composite layup material may be unidirectional carbon and fiberglass material, the second composite layup material may be fiberglass plies, and the molded material may be plastic.

In another aspect, the juncture-handle portion may include a second tab reinforcing member extending from the handle portion, through the throat member, and to the second fork member, and defining a second tab protruding beyond a distal forward end of the second fork member. The second tab reinforcing member may be formed of the second composite layup material. The second sidewall portion may be molded over the second tab reinforcing member.

In another aspect, the juncture-handle portion and the head portion may form a unitary structure.

In another aspect, the handle portion may be a full-length handle.

In another aspect, the lacrosse stick may further include a shaft connected to the handle portion of the juncture-handle portion.

In another aspect, the throat member, the first fork member, the first sidewall portion, the transverse wall portion, the second sidewall portion, and the second fork member may form a pocket frame having a front side and a back side. The throat member may define a ball stop member. The head portion may further include a ball stop stringing member that connects the first sidewall portion and the second sidewall portion and may be molded to a back side of the ball stop member. The ball stop stringing member may define a stringing opening.

In another aspect, the first tab reinforcing member may further define a second tab protruding from the back side of the ball stop member, and the ball stop stringing member may be molded over the second tab.

In another aspect, the ball stop member may define an opening, and material of the ball stop stringing member may be disposed within the opening.

In another aspect, the first fork member may have a first height in a front-to-back direction and a first width perpendicular to the first height. The first fork member may define a first contact surface that is lateral to a longitudinal direction in which the first fork member extends. The first tab may have a second width less than the first width and may protrude from the first contact surface. The first sidewall portion of the head portion may define a second contact surface that is lateral to a longitudinal direction in which the first sidewall portion extends. The first contact surface may contact the second contact surface.

In another aspect, when the lacrosse stick is viewed from a side elevation view with a front face of the head portion facing up, the first contact surface may contact the second contact surface along a substantially linear seam extending from a front edge downwardly and rearwardly at a seam angle.

In another aspect, the seam angle may be within a range of about 20 degrees to about 70 degrees, relative to a horizontal centerline of a majority handle length of the lacrosse stick.

In another aspect, the throat member may include a composite layup ball stop wall and a filler material disposed between the first tab reinforcing member and the composite layup ball stop wall.

In another aspect, the filler material may be an epoxy.

In another aspect, the first tab may define an opening through which the molded material of the head portion is disposed.

In another aspect, the distal forward end of the first fork member may define a raised edge that protrudes from a surface of the first tab and defines a first portion of an interlocking connection. The molded material of the head portion may be disposed adjacent to the raised edge and define a second portion of the interlocking connection. The first portion of the interlocking connection may be interlocked with the second portion of the interlocking connection.

In another aspect, the raised edge may define a seam between the juncture-handle portion and the head portion.

In another aspect, the molded material of the head portion may overlap the raised edge and contact an outer surface of the first fork member.

Another embodiment provides a method for making a lacrosse stick. The method may include laying up first composite material to form a handle portion having a rearward end portion and a forward end portion, and attaching a first ply stackup to a first side of the forward end portion of the handle portion and a second ply stackup to a second side of the forward end portion of the handle portion. The first and second ply stackups may be stiffer than the first composite material layup. The method may further include laying up second composite material around the first and second ply stackups to form a stop member, a juncture, a first fork member, and a second fork member. The first ply stackup may define a first tab protruding from the first fork member and the second ply stackup may define a second tab protruding from the second fork member. The method may further include applying heat and pressure to the composite material layups and the first and second ply stackups, to cure and join the layups and stackups, to form a juncture-handle portion. The method may further include placing the juncture-handle portion in a mold that defines a cavity corresponding to a head portion of the lacrosse stick. The cavity may enclose the first tab and the second tab. The method may further include placing moldable material into the cavity to form the head portion, wherein the moldable material flows around and attaches to the first tab and the second tab, and removing the attached head portion and juncture-handle portion from the mold.

In another aspect, the handle portion may be a full-length shaft.

In another aspect, the method may further comprise attaching a handle to the handle portion.

In another aspect, before applying heat and pressure, the method may further comprise adding filler material within the second composite material layup to adjust a balance of the lacrosse stick.

In another aspect, the cavity may define a ball stop stringing member of the head portion of the lacrosse stick over a back side of the stop member, and the moldable material may attach to the back side of the stop member.

In another aspect, the first and second composite materials may be unidirectional carbon and fiberglass material, the first and second ply stackups may be fiberglass plies, and the moldable material may be plastic.

In another aspect, the moldable material may comprise a plastic resin and the first and second composite materials may contain the plastic resin.

Another embodiment provides a lacrosse stick having a juncture-handle portion and a head portion. The juncture-handle portion may include a throat member, a first fork member extending from the throat member in a forward direction, a second fork member extending from the throat member in the forward direction, a handle portion extending from the throat member in a rearward direction, and a first tab protruding beyond a distal forward end of the first fork member. The distal forward end of the first fork member may define a raised edge that protrudes from a surface of the first tab and defines a first portion of an interlocking connection. The head portion may be made of a molded material and may include a first sidewall portion molded over the first tab and extending from the first fork member in the forward direction, a second sidewall portion extending from the second fork member in the forward direction, and a transverse wall portion connecting the first sidewall portion and the second sidewall portion opposite to the juncture-handle portion. The molded material of the head portion may be disposed adjacent to the raised edge and may define a second portion of the interlocking connection. The first portion of the interlocking connection may be interlocked with the second portion of the interlocking connection. The head portion may be more flexible than the juncture-handle portion.

In another aspect, the juncture-handle portion and the head portion may define a pocket frame having a front side and a rear side, and when viewed from a side view with the front side facing up, the first tab may define a first forward opening, a second forward opening, and a third rearward opening. The first forward opening, the second forward opening, and the third rearward opening may be arranged in a triangular configuration, with the first one forward opening positioned vertically above the second forward opening, and with the third rearward opening positioned rearward of both of the first forward opening and the second forward opening. The head portion may define a first post in the first forward opening, a second post in the second forward opening, and a third post in the third rearward opening.

In another aspect, when viewed from the side view with the front side facing up, the second portion of the interlocking connection may include a vertically extending base, a horizontally extending arm, and a vertically extending hook. The first post and the second post may be disposed in the vertically extending base and the third post may be disposed in the vertically extending hook.

Other systems, methods, features, and advantages of the disclosure will be, or will become, apparent to one of ordinary skill in the art upon examination of the following figures and detailed description. It is intended that all such additional systems, methods, features, and advantages be included within this description and this summary, be within the scope of the disclosure, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

FIG. 17 is a table that compares material characteristics of an Epoxide juncture-handle portion to a PA6 Ultram id B27 juncture-handle portion, relative to a PA6 ST801 lacrosse head, according to an embodiment;

FIG. 18 is a table and corresponding photographs, providing results of stiffness testing of samples of present embodiments and of previous lacrosse sticks;

FIGS. 24.1 and 24.2 are images that illustrate a finite element analysis study of the lacrosse stick of FIGS. 22-23, according to an embodiment;

DETAILED DESCRIPTION

Embodiments provide a lacrosse stick having a continuous juncture-handle portion and a flexible head portion molded to the juncture-handle portion, and a method for making the lacrosse stick.

Figure 1:
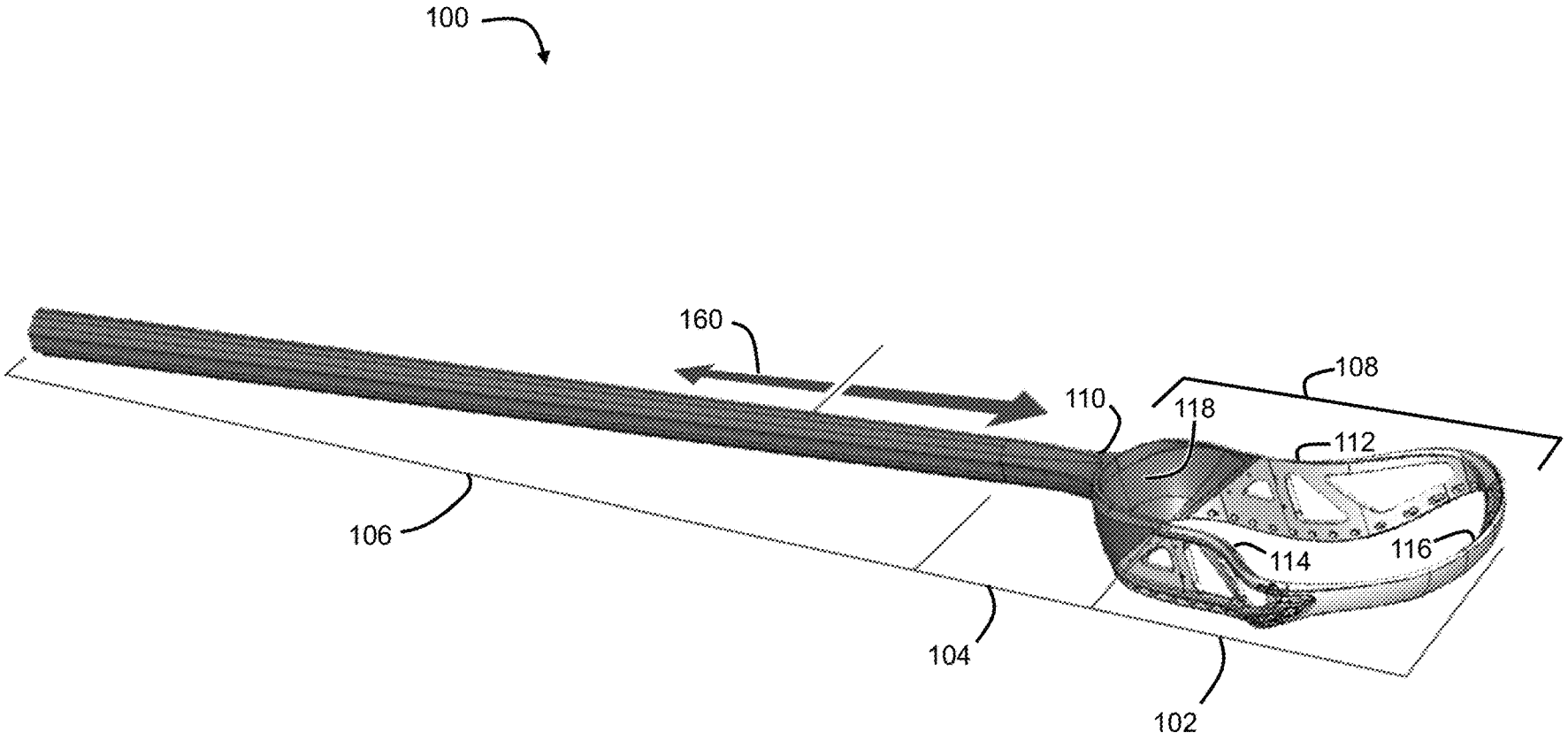
FIG. 1 is a schematic diagram of a perspective view of a lacrosse stick according to an embodiment.
Figure 2:
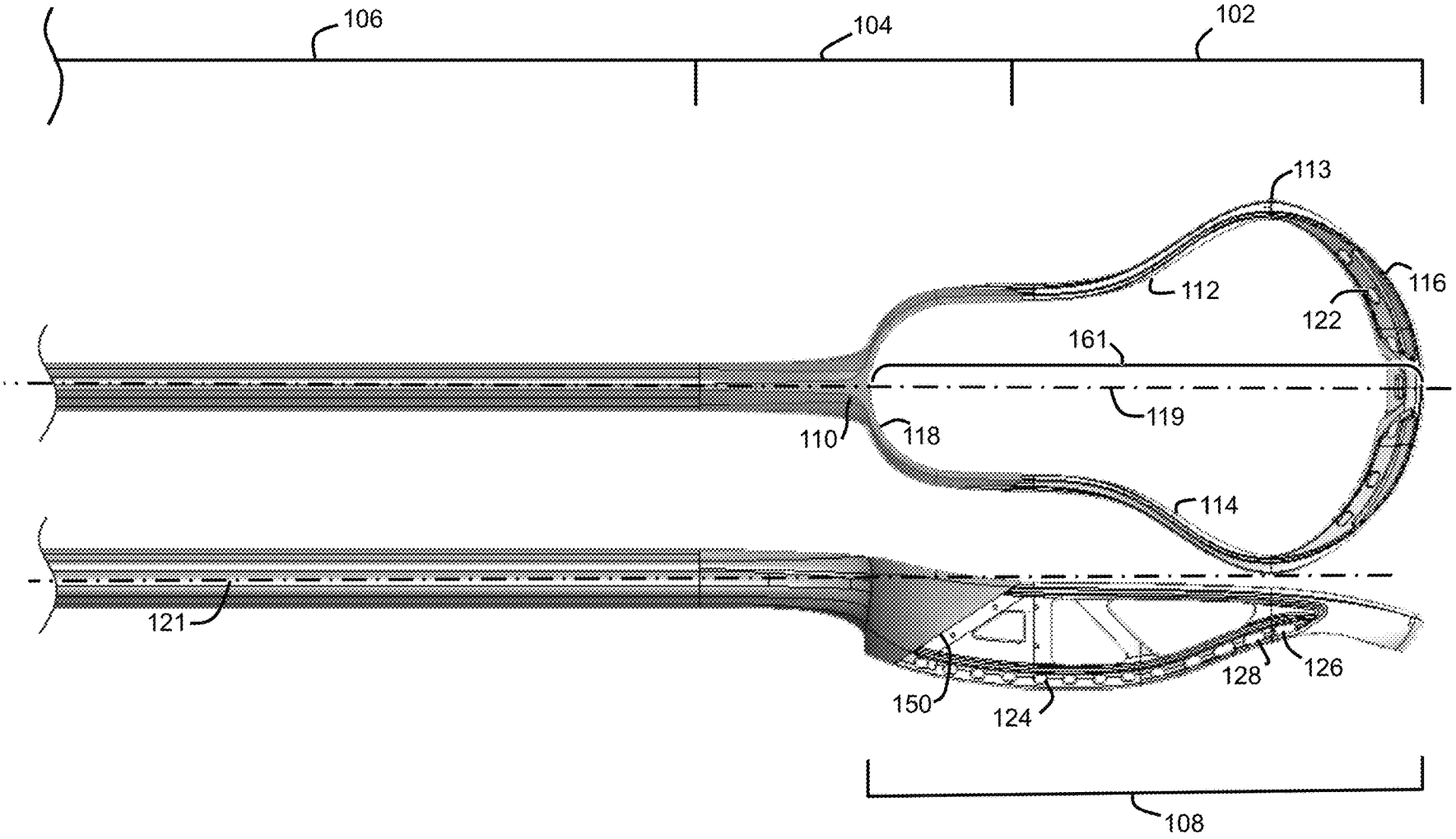
FIG. 2 is a schematic diagram of a partial front view and a partial side view of the lacrosse stick of FIG. 1.

FIGS. 1 and 2 illustrate an embodiment of a lacrosse stick 100, including a head portion 102, a juncture-handle portion 104, and an extended shaft portion 106. As used herein, "stick" refers to the stick as a whole, including head portion 102, juncture-handle portion 104, and shaft portion 106. Head portion 102 and juncture-handle portion 104 may together form a double-wall synthetic head 108 having a generally V-shaped frame, or pocket frame. Head 108 may have a juncture 110, sidewalls 112 and 114, a transverse wall (or "scoop") 116 joining the sidewalls at their ends opposite juncture 110, and a stop member (or "ball stop") 118 adjoining juncture 110 and joining sidewalls 112 and 114 at their ends nearest juncture 110. The frame may be considered to extend from a rearward end at the juncture 110 to a forward end at the transverse wall 116. As shown in FIG. 1, shaft portion 106 may be connected to juncture-handle portion 104 and define (by a majority length of shaft portion 106) a horizontal centerline 121 of the shaft portion 106 and head 108 as shown, for example, in the side elevation view of FIG. 2, as well as a longitudinal bisecting line 119 as shown, for example, in the front view of FIG. 2 (bisecting the head 108 longitudinally into two halves). Shaft portion 106 may also include integral grip portions and/or an integral end cap. Features of lacrosse sticks are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

In embodiments, lacrosse stick head 108 may have a "traditional" pocket configuration, a "mesh" pocket configuration, a pre-formed or molded configuration, or any combination of those configurations. The traditional pocket may include thongs made of leather or synthetic material strung from stringing openings, tabs, and/or thong holes, at forward portions of the head 108 to rearward stringing openings or thong holes in stop member 118. In embodiments, referring to FIG. 2, the thong holes at forward portions of the head 108 may include forward thong holes 122 in transverse wall 116. To complete the pocket web, the thongs may have nylon strings threaded around the thongs and string laced through stringing openings, tabs, and/or slots in sidewalls 112 and 114, forming any number of diamonds or other shapes (crosslacing).

In traditional pockets, thongs (not shown in FIGS. 1 and 2) made of leather or synthetic material may extend from forward thong holes 122 to rearward thong holes in stop member 118. As one embodiment, FIG. 2 shows seven thong holes that may accept seven thongs. Other numbers of thongs and thong holes may be used. To complete the pocket web, nylon strings may be threaded around the thongs and string may be laced through stringing openings 124 in sidewalls 112 and 114, forming any number of diamonds or other shapes (crosslacing). In embodiments, one or more throwing or shooting strings may extend transversely between the forward portions of sidewalls 112 and 114, attaching to throwing string openings 126 and a string laced through stringing openings 128. In embodiments, a thong may not be attached directly to a stringing opening, and instead may be connected to a separate material that attaches the thong to the lacrosse head frame and that is easier to adjust through the stringing opening. In addition, in some embodiments, a top string (e.g., nylon string) may be strung along the forward thong holes 122, and the thongs may be attached to the top string.

A mesh pocket configuration may use a mesh knitted as a continuous piece of material. This continuous piece of material may attach to the lacrosse head as a single unit. The mesh may be attached to the lacrosse head using transverse lacing, which may reinforce the web of the mesh that is adjacent to the lacrosse head.

In embodiments, a pre-formed or molded pocket configuration may be integral with juncture-handle portion and/or the head portion. For example, a pocket may be molded together with the head portion and made of the same plastic material.

As exemplified in FIGS. 1 and 2, embodiments may include provisions for improving the performance of a lacrosse stick in terms of, for example, weight, balance, hand-placement, and durability. Lacrosse stick 100 may include a juncture-handle portion 104 made of composite materials and a head portion 102 made of moldable material, such as plastic. The composite materials of the juncture-handle portion 104 may include unidirectional carbon and fiberglass layups along with stacked fiberglass plies. The carbon layups and fiberglass plies may be positioned through the juncture-handle portion 104 at particular locations to achieve desired structures and stiffness, as discussed in more detail below. The composite construction may allow for a strong, unitary head-to-shaft connection that minimizes and evenly distributes material in the juncture area of a lacrosse stick, to reduce weight, provide a desired balance point, and increase durability of the connection. The unitary construction and smooth transition in the juncture area may also allow hand placement very close to the head 108, to enhance a player's feel and control for a ball in the pocket of the lacrosse stick.

In embodiments, the moldable material of head portion 102 may be a material that can be molded onto the composite material of juncture-handle portion 104 and strongly adhere to the composite material. Examples of suitable materials for head portion 102 according to the present embodiments include nylon, elastomers, metal, urethane, polycarbonate, polyethylene, polypropylene, polyketone, polybutylene terephalate, acetals (e.g., Delrin™ by DuPont), acrylonitrile-butadiene-styrene (ABS), acrylic, acrylic-styrene-acrylonitrile (ASA), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), and polyvinyl chloride (PVC). Relative to the composite materials of the juncture-handle portion 104, the moldable material of the head portion 102 may be more flexible and less prone to cracking and breaking. This difference in material properties may enable the lacrosse stick to accommodate the typical rigors of the lacrosse play, allowing the head portion 102 to bend, twist, and compress, and return to its original shape, during lacrosse skills such as a draws, defensive stick checks, and throws.

To provide a complete lacrosse stick, shaft portion 106 may be formed along with the juncture-handle portion 104 using continuous and/or overlapping composite materials, such that both the juncture-handle portion 104 and shaft portion 106 comprise a unitary composite construction. In alternative embodiments, shaft portion 106 could be formed of a material different from the composite material of juncture-handle portion 104 and can be mechanically and/or chemically bonded to juncture-handle portion 104. For example, shaft portion 106 could be made of wood, metal (e.g., aluminum, titanium, scandium, CU31, C405, and C555), or plastic.

Figure 6:
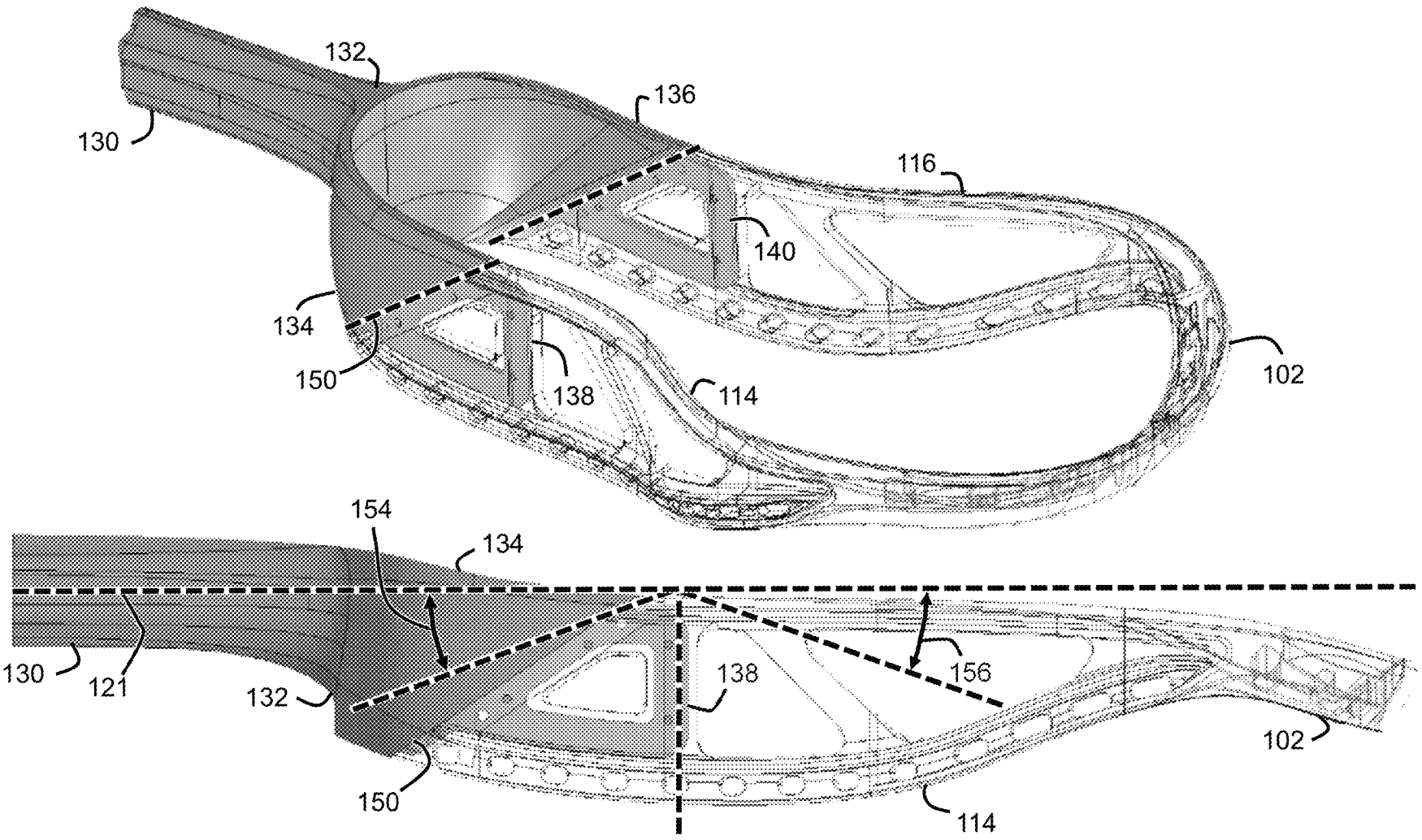
FIG. 6 is a schematic diagram of a perspective view and a side view of the juncture-handle portion and the head portion of the lacrosse stick of FIG. 1, illustrating a range of possible seam configurations according to embodiments.
Figure 7:
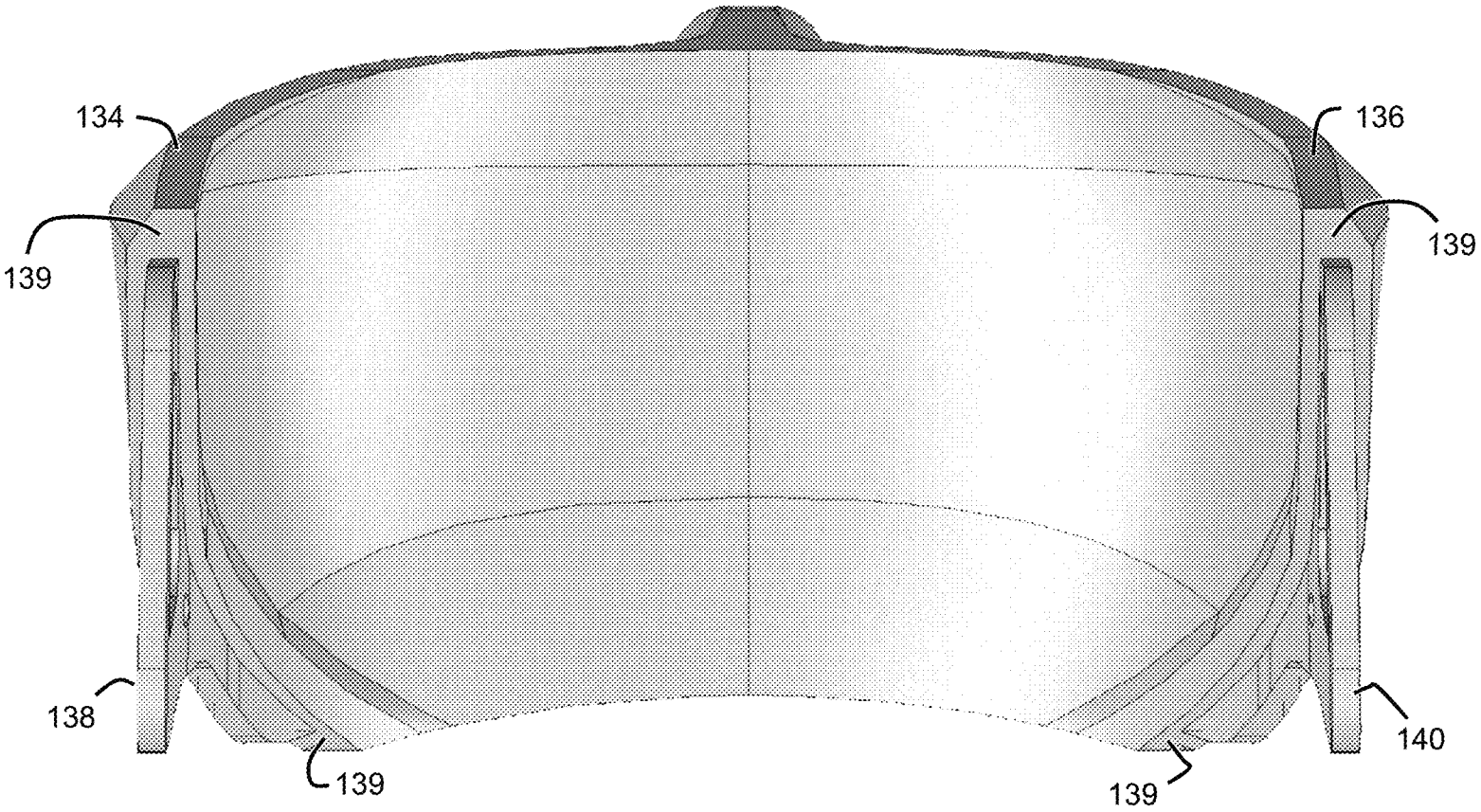
FIG. 7 is a schematic diagram of a top view of the juncture-handle portion of the lacrosse stick of FIG. 1.
Figure 8:
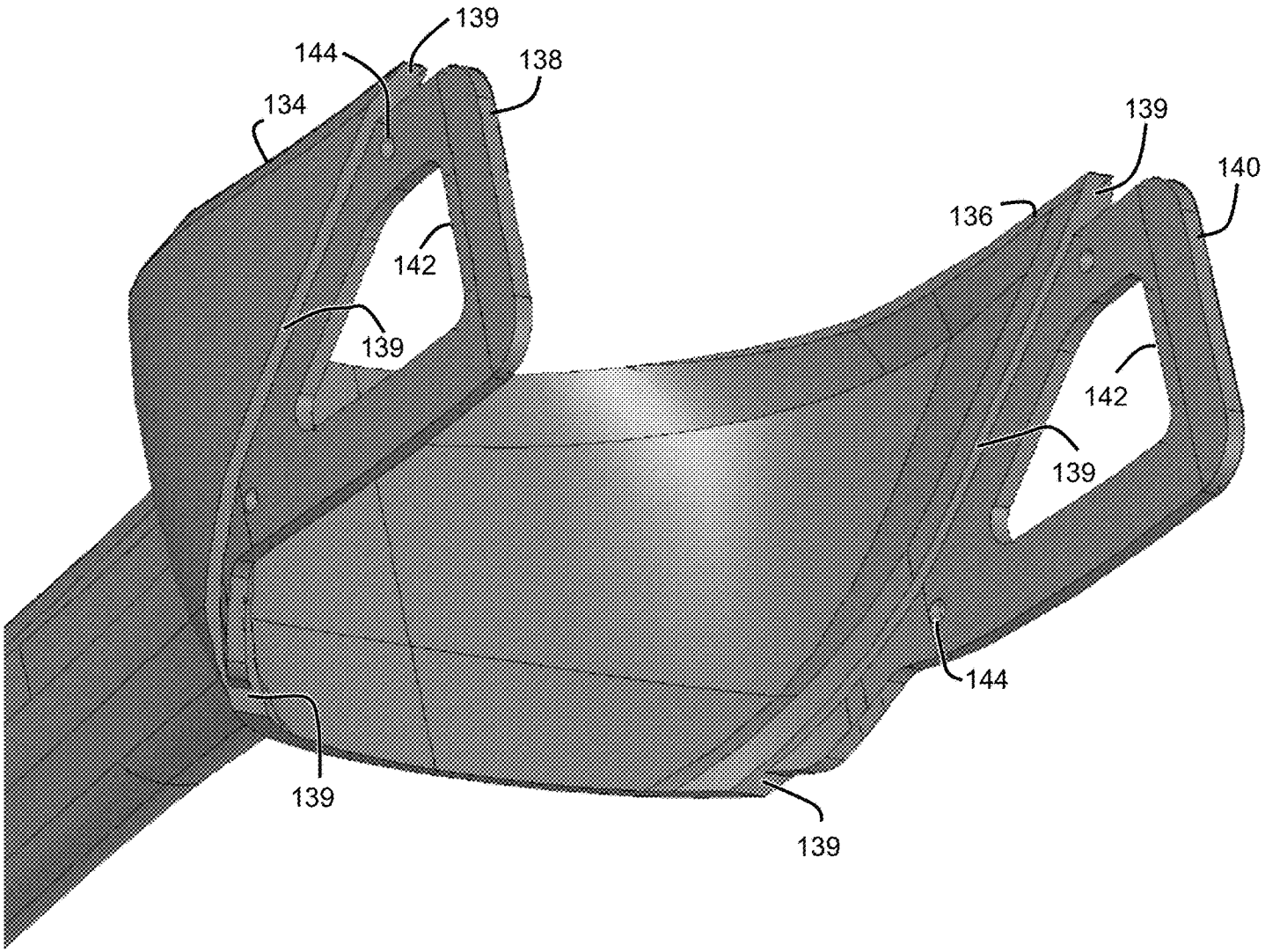
FIG. 8 is a schematic diagram of a partial, back perspective view of the juncture-handle portion of the lacrosse stick of FIG. 1.

To provide a strong unitary construction through the length of a lacrosse stick, embodiments may include provisions for reinforcing the juncture 110 and the connection between the juncture-handle portion 104 and the head portion 102. As shown in FIGS. 3-6, juncture-handle portion 104 may include a handle portion 130, a throat member 132, a first fork member 134, a second fork member 136, a first tab 138, and a second tab 140. Each of tabs 138, 140 may protrude beyond a distal forward end of respective fork members 134, 136, to provide a structure over which head portion 102 may be molded. In embodiments, tabs 138, 140 may be stiffer than fork members 134, 136. As shown in FIGS. 4, 7, and 8, in embodiments, tabs 138, 140 may have a lateral cross-sectional area that is less than the lateral cross-sectional area of the respective fork members 134, 136, which may allow the moldable material of the head portion 102 to enclose the tabs 138, 140 and form a continuous structure (e.g., sidewall) with the fork members 134, 136. As shown in FIGS. 7 and 8, the small lateral cross-sectional area of tabs 138, 140 may also be spaced apart from the edges of the faces 139 of the fork members 134, 136, to provide continuous faces 139 (forming a frame-like configuration) around the tabs 138, 140, and allow the moldable material of head portion 102 to flow completely around the tabs 138, 140 within a mold cavity. The continuous faces 139 may securely contact the moldable material of head portion 102 and fully enclose the tabs 138, 140, to provide a strong, durable connection between the juncture-handle portion 104 and the head portion 102.

In embodiments of the smaller lateral cross-sectional area of the tabs, the lateral thickness of a tab may be within a range of about 1 mm to about 13 mm thinner than the lateral thickness of its corresponding fork member, which may range in thickness from about 2 mm to about 15 mm. In one implementation, the lateral thickness of a tab may be about 2 mm thick and about 2.5 mm thinner than the lateral thickness of its corresponding fork member having a thickness of about 4.5 mm.

Figure 3:
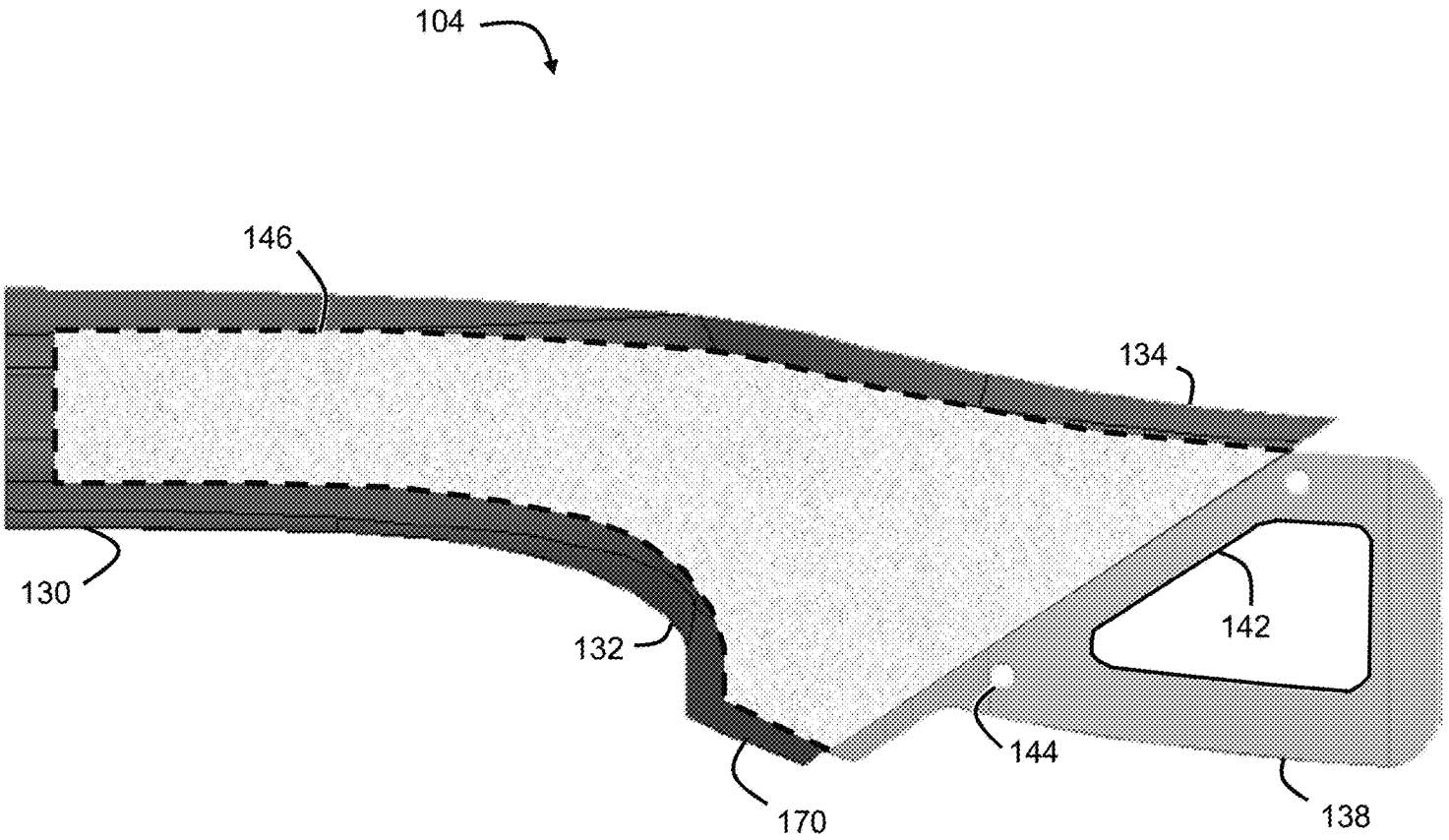
FIG. 3 is a schematic diagram of a juncture-handle portion of a lacrosse stick according to an embodiment.
Figure 4:
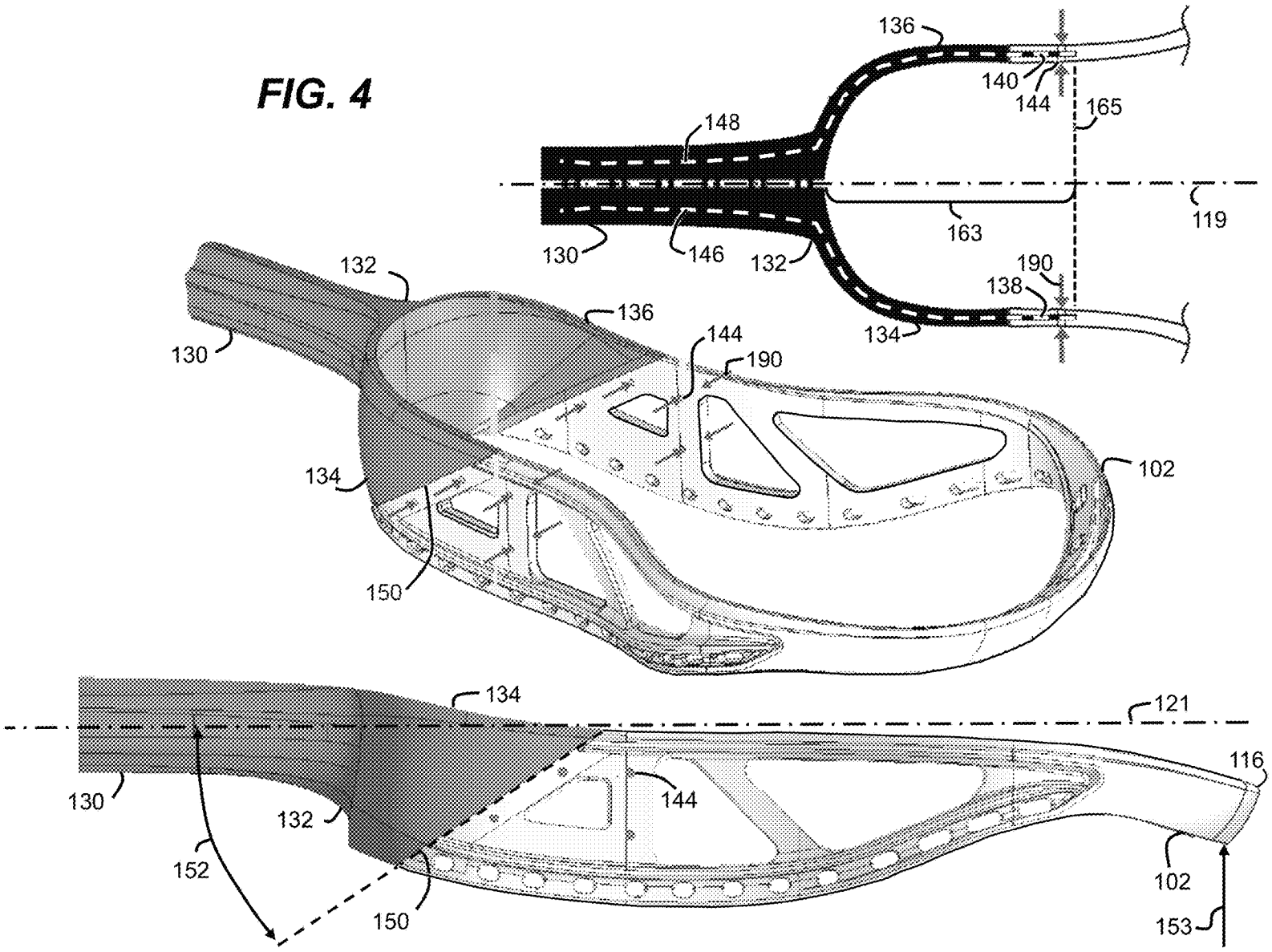
FIG. 4 is a schematic diagram of a perspective view, a side view, and a partial front view of the juncture-handle portion and the head portion of the lacrosse stick of FIG. 1.
Figure 5:
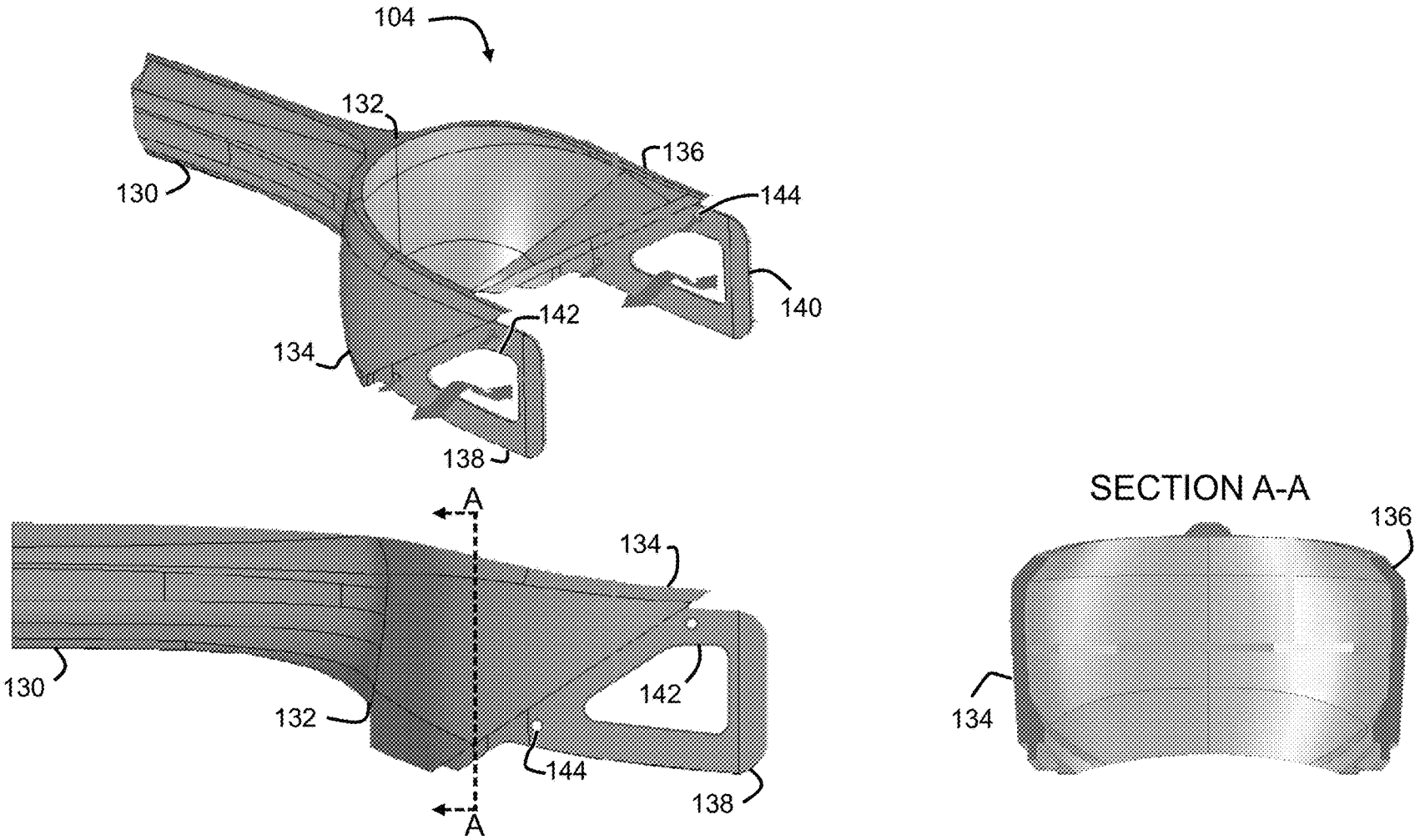
FIG. 5 is a schematic diagram of a perspective view, a side view, and a cross-sectional view of the juncture-handle portion of the lacrosse stick of FIG. 1.

As shown in FIGS. 3, 5, and 8, to further strengthen the connection, tabs 138, 140 may have openings 142 through which moldable material (e.g., plastic) of head portion 102 may flow during molding and in which the moldable material may be disposed in the finished lacrosse stick 100. This configuration may increase the strength of the mechanical and chemical connection. Although openings 142 are shown with particular shapes, sizes, and locations, openings 142 could be fashioned in other shapes, sizes, and locations, such as an array of circular holes.

As shown in FIGS. 3-5 and 8, tabs 138, 140 may also have pin holes 144 to facilitate proper positioning of tabs 138, 140 within an injection mold tool (as represented by the arrows 190), for example, centered within the sidewall as shown in the upper right schematic of FIG. 4. This positioning may allow better control over the thickness of the moldable material and the dispersion of the moldable material around the tabs.

To reinforce the juncture 110, juncture-handle portion 104 may include a body formed of unidirectional carbon and fiberglass layups, reinforced with stiffer separate stackups of fiberglass plies. For example, as shown in FIGS. 3-4, a first fiberglass ply stackup 146 (represented in phantom dashed lines) may extend from the handle portion 130, through the throat member 132, and to the first fork member 134, and may protrude from a distal forward end of the first fork member 134 to define tab 138. A second fiberglass ply stackup 148 may extend from the handle portion 130, through the throat member 132, and to the second fork member 136, and may protrude from a distal forward end of the second fork member 136 to define tab 140. To provide the reinforcement, the first and second fiberglass ply stackups 146 may be stiffer than the material of handle portion 130, throat member 132, first fork member 134, and second fork member 136. In embodiments, fiberglass ply stackups 146, 148 may be fully enclosed (except for tabs 138, 140) within the unidirectional carbon and fiberglass layups. In other embodiments, the fiberglass ply stackups 146, 148 may be partially enclosed in the unidirectional carbon and fiberglass layups, for example, being exposed at the juncture 110 and/or the stop member 132.

Juncture-handle portion 104 may be solid, or to reduce weight, may be hollow or partially hollow. In embodiments, handle portion 130 and throat member 132 are solid. In addition, to reinforce the ball stop and provide a customized balance point, embodiments may include additional material enclosed in the throat member 132. For example, epoxy material may be disposed inside the throat member 132 between a ball stop formed from unidirectional carbon and fiberglass layups, a first fiberglass ply stackup on one side of the juncture, and a second fiberglass ply stackup on the opposite side of the juncture, as further described below in embodiments of manufacturing a lacrosse stick.

For further strength, juncture-handle portion 104 may include provisions for increasing the stiffness of the fork members 134, 136 using structural geometries. For example, as shown in the Section A-A of FIG. 5, first fork member 134 and second fork member 136 may have cupped walls, as opposed to flat walls. The cupped walls may be concave as shown in FIG. 5, or may be convex. In embodiments, both the fork members 134, 136 and also the fiberglass ply stackups 146, 148 may provide a cupped geometry. Other non-flat strengthening geometries are also possible such as triangular or corrugated geometries.

To reinforce the connection between the juncture-handle portion 104 and the head portion 102, embodiments may include provisions for reducing stress and strain where the material of the juncture-handle portion 104 and material of the head portion 102 meet. Although a seam between juncture-handle portion 104 and head portion 102 could be vertical and linear (when viewed from a side elevation view), embodiments may provide non-vertical and/or non-linear seams, which may increase the contact surface area between the components, reduce stress concentrations, and resist forces from more directions. In one embodiment, as shown in FIGS. 1-6, a seam 150 may be linear and angled downwardly and rearwardly from the upper edge of the sidewall when viewed from a side elevation view with the front side facing up, as in the lowermost schematics in FIGS. 4 and 6. Along that seam 150, both the juncture-handle portion 104 and the head portion 102 may have lateral faces that contact each other. As shown, for example, in FIGS. 7-8, for the juncture-handle portion 104, a fork member may provide lateral contacting surfaces 139 around a protruding tab. Compared to a vertical orientation (when viewed from a side elevation), the longer angled seam 150 may provide a greater area of contact between the components, which may increase the strength and durability of the connection by spreading stress across the greater contact area when the head 108 is subject to forces, such as side forces.

As shown in FIG. 4, in one embodiment, seam 150 may be positioned at an angle 152 of approximately 33 degrees with respect to the horizontal centerline 121 of the lacrosse stick. That particular angle may be especially helpful in reinforcing the head 108 against forces applied to the transverse wall 116 in a generally upward direction (as represented by arrow 153 in FIG. 4), for example, when pressing the lacrosse stick against the ground during scooping maneuvers. In other embodiments, as shown in FIG. 6, an angled linear seam may vary in position from an angle 154 of approximately 20 degrees in the downward and rearward direction with respect to the horizontal centerline 121 to an angle 156 of approximately 20 degrees in the downward and forward direction with respect to the horizontal centerline 121. In one embodiment, angles 154 and 156 are within a range of about 20 degrees to about 70 degrees, relative to horizontal centerline 121.

Figure 9:
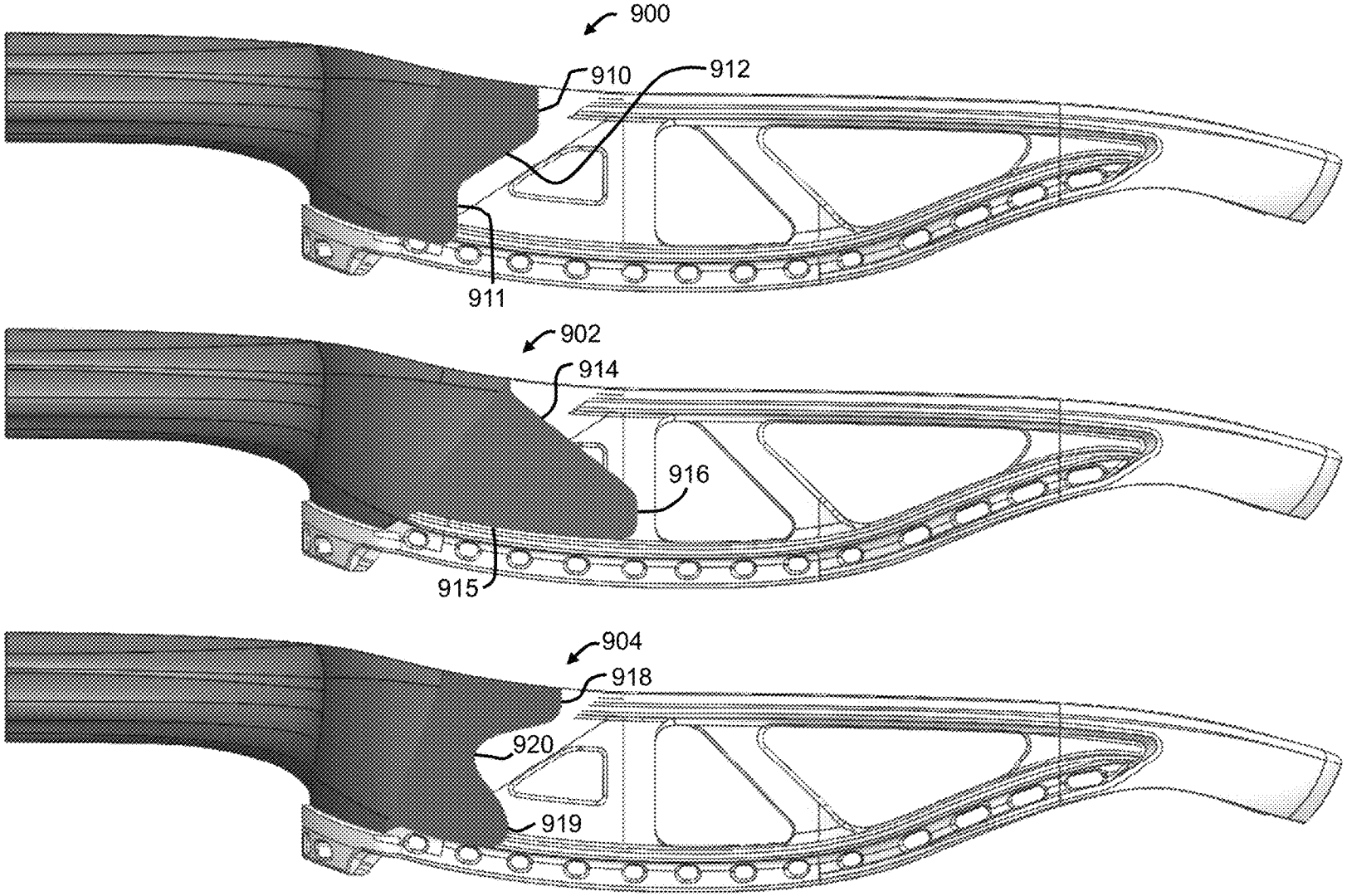
FIG. 9 is a schematic diagram of partial side views of lacrosse sticks having different seam configurations, according to alternative embodiments.

In other embodiments, nonlinear seams may provide increased surface contact area between juncture-handle portion 104 and head portion 102, and may resist forces applied to head 108 in more directions. For example, FIG. 9 illustrates three alternative embodiments of seams. Seam 900, when viewed from a side view as in FIG. 9, has an upper vertical section 910, a lower vertical section 911, and an angled intermediate section 912 that connects the upper and lower vertical sections and is angled downwardly and rearwardly. Seam 902, when viewed from a side view as in FIG. 9, has an upper angled section 914 angled downwardly and forwardly, a generally horizontal lower section 915 extending rearwardly, and a vertical intermediate section 916 connecting the upper angled section 914 to the horizontal lower section 915. Seam 904, when viewed from a side view as in FIG. 9, has a generally notched configuration, with an upper protruding section 918 protruding forwardly, a lower protruding section 919 protruding forwardly, and a notched section 920 receding rearwardly between the upper protruding section 918 and the lower protruding section 919.

Embodiments may also include provisions for joining a juncture-handle portion and a head portion using a first internal interlocking mechanical connection and a second external interlocking mechanical connection. As described above, tabs with openings (e.g., tabs 138, 140 of FIGS. 3-6) may provide a first internal interlocking mechanical connection. In addition to such internal mechanical connections, embodiments may also provide an external mechanical connection having geometries that interlock to resist forces in more directions. Thus, in comparison to connections that meet face-to-face, such as the linear seam 150 of FIGS. 1-6, which may resist forces pushing the surfaces together and provide limited resistance against forces pulling the surfaces apart, interlocking connections may significantly resist both pushing and pulling forces.

Figure 19:
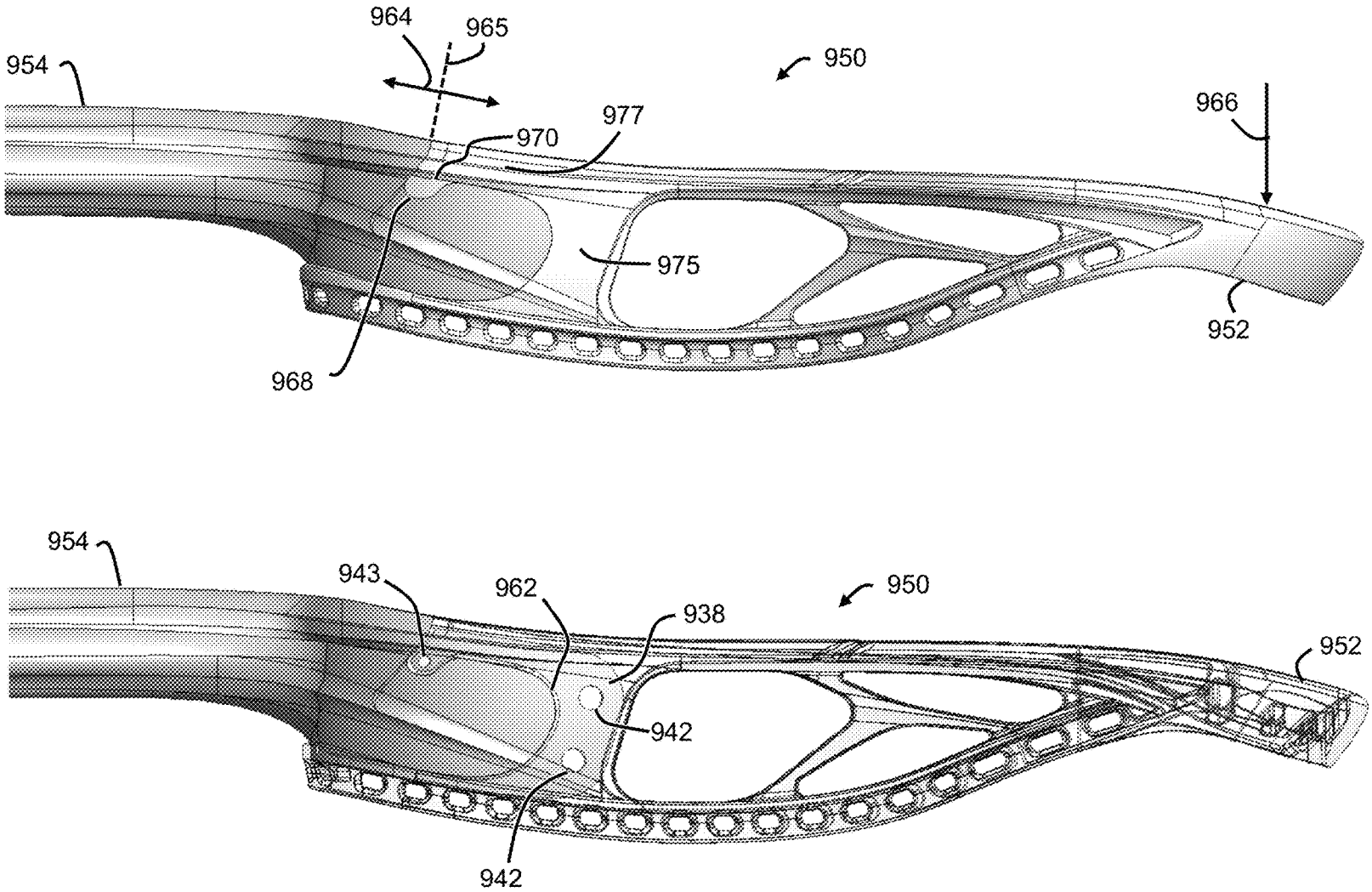
FIG. 19 is a schematic diagram that illustrates partial side views of an embodiment of a lacrosse stick having both internal and external interlocking mechanical connections, shown at the top of FIG. 19 with the head portion solid and at the bottom of FIG. 19 with the head portion transparent.
Figure 20:
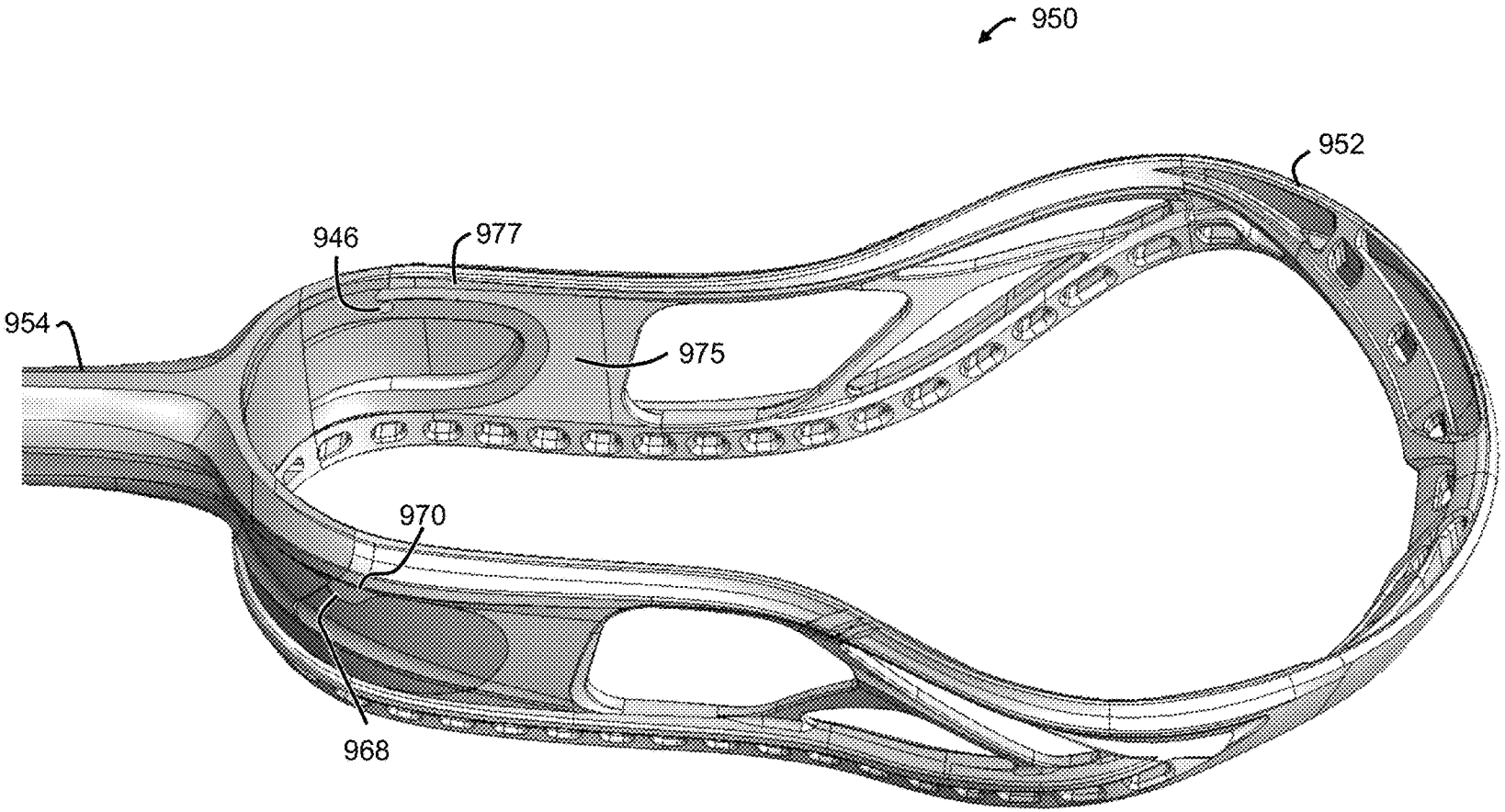
FIGS. 20 and 21 are schematic diagrams that illustrate partial perspective views of the lacrosse stick of FIG. 19, shown with the head portion solid in FIG. 20 and with the head portion transparent in FIG. 21.
Figure 21:
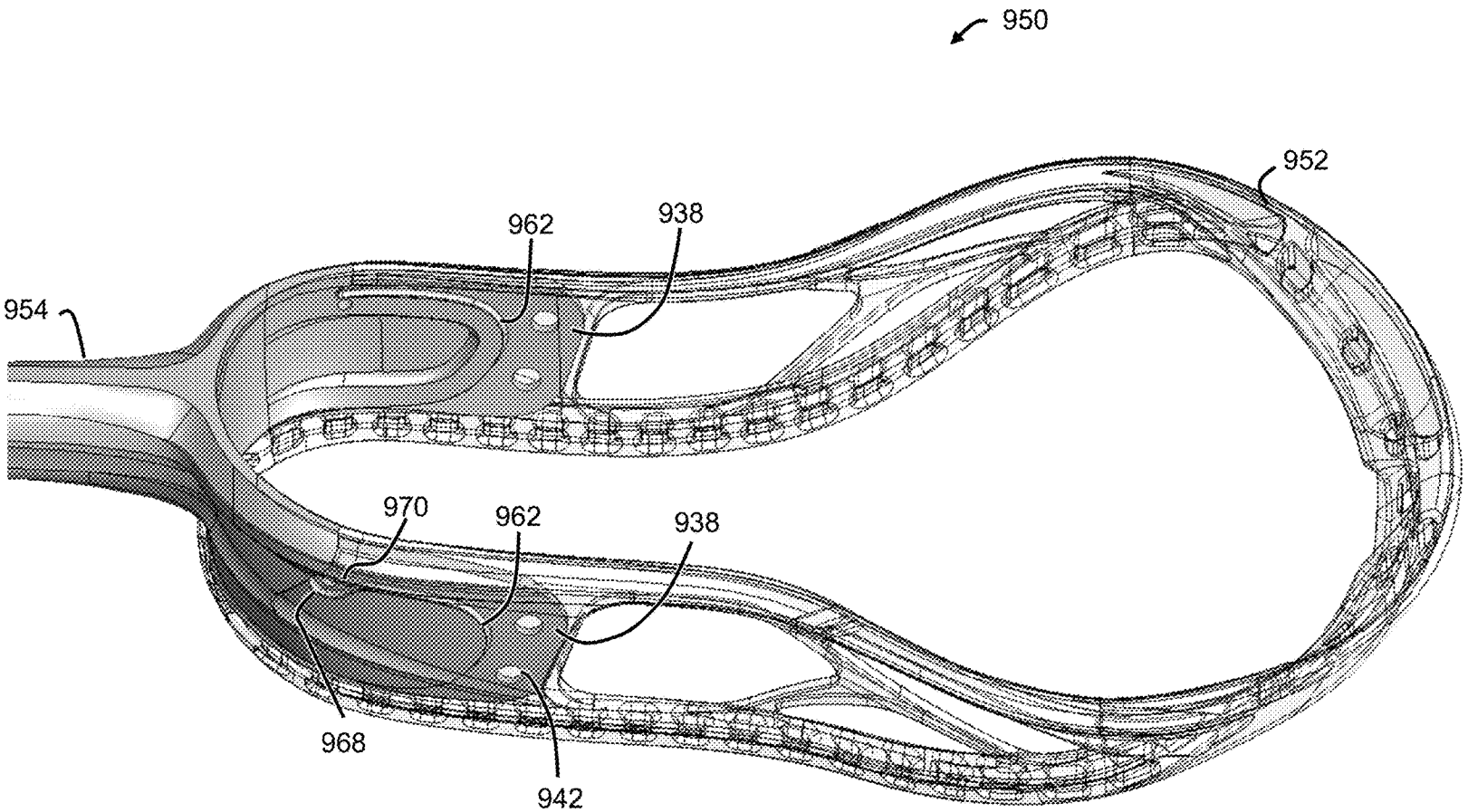

As an example, FIGS. 19-21 illustrate an embodiment of a lacrosse stick 950 having both internal and external interlocking mechanical connections. In FIG. 19, the top schematic illustrates the lacrosse stick 950 with the head portion 952 shown solid such that only the external connection is visible, whereas the bottom schematic illustrates the lacrosse stick 950 with the head portion 952 shown transparent, such that the internal and external connections are both visible. FIGS. 20 and 21 illustrate perspective views of the lacrosse stick 950 with the head portion 952 solid and transparent, respectively.

As shown, juncture-handle portion 954 may have a tab 938 that defines openings 942, 943 through which moldable material (e.g., plastic) of head portion 952 may flow during molding and in which the moldable material may be disposed in the finished lacrosse stick 950, to provide internal interlocking mechanical connections. Inside of the openings 942, 943, the head portion 952 may define posts that span the width of the tab 938 and provide a sturdy mechanical connection between the head portion 952 and the juncture-handle portion 954. FIG. 20 illustrates an example of a post 946 disposed in an opening 943. The openings 942, 943 may also be positioned to counter forces that are typically applied to a lacrosse head. For example, referring to FIG. 19, in one embodiment, when viewed from a side view as in FIG. 19, two forward openings 942 and one rearward opening 943 may be arranged in a triangular configuration, with one upper forward opening 942 positioned vertically above a second lower forward opening 942, and with the rearward opening 943 positioned rearward of both of the forward openings 942 and slightly above the upper forward opening 942. The mechanical connection between the opening 943 of tab 938 and the post 946 of the head portion 952 disposed within the opening 943, may provide additional resistance against forces pulling the head portion 952 and juncture-handle portion 954 apart, as represented by the arrow 964 and dashed line 965 in FIG. 19. Such pulling forces may occur when a force is applied against a front face of the lacrosse head in a direction generally toward the pocket, as represented by the arrow 966 in FIG. 19. The connection between the opening 943 and the corresponding post 946 of the head portion 952 may provide beneficial resistance and strength in countering the considerable amounts of torque resulting from forces typically applied at the scoop of the lacrosse head, a long distance from the connection between the head portion 952 and the juncture-handle portion 954.

For the external interlocking mechanical connections, in embodiments, the juncture-handle portion 954 may form a raised edge 962, which protrudes from the surface of the tab 938 and defines an interlock opening 968. In turn, the head portion 952 may define an interlock projection 970 that is disposed within, and interlocked with, the interlock opening 968. The interlock projection 970 may be formed when moldable material of the head portion 952 flows into a space between the tab 938 and walls of a molding tool in which the head portion 952 is molded. In embodiments, the interlock opening 968 and interlock projection 970 may provide additional resistance against forces pulling the head portion 952 and juncture-handle portion 954 apart, as represented by the arrow 964 and dashed line 965. Such pulling forces may occur when a force is applied against a front face of the lacrosse head in a direction generally toward the pocket, as represented by the arrow 966 in FIG. 19.

As shown in the side view of FIG. 19, to provide an interlocking configuration, head portion 952 may define, for example, a vertically extending base 975, a horizontally extending arm 977, and a vertically extending hook 970, which is also described as interlock projection 970 above. Referring to the transparent view in FIG. 19, a first post and a second post of the head portion 952 may be disposed in the vertically extending base 975 inside the openings 942 defined by the tab 938, and a third post of the head portion 952 may be disposed in the vertically extending hook 970 inside the opening 943 defined by the tab 938.

Figure 22:
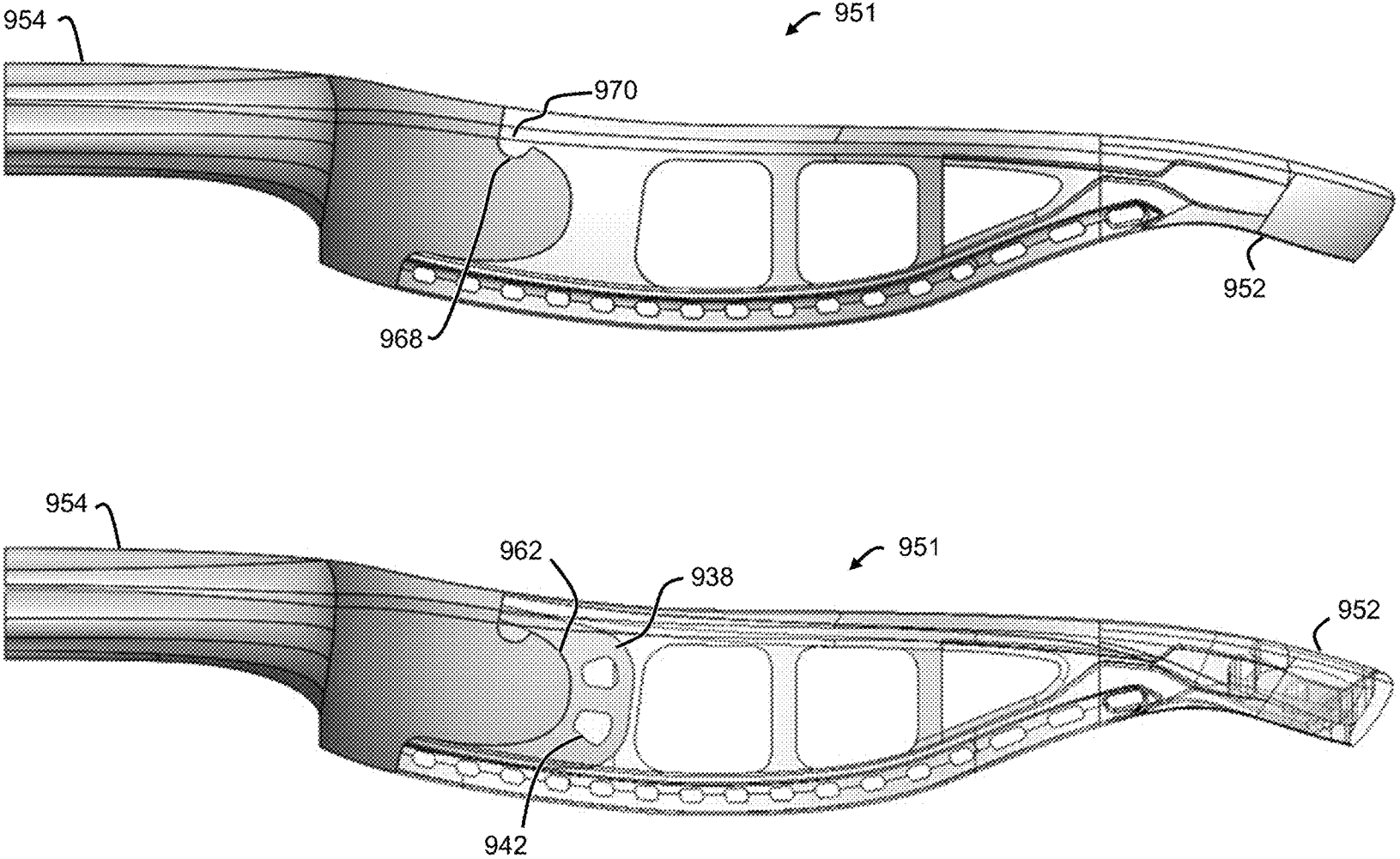
FIG. 22 is a schematic diagram that illustrates partial side views of another embodiment of a lacrosse stick having both internal and external interlocking mechanical connections, shown at the top of FIG. 22 with the head portion solid and at the bottom of FIG. 22 with the head portion transparent.
Figure 23:
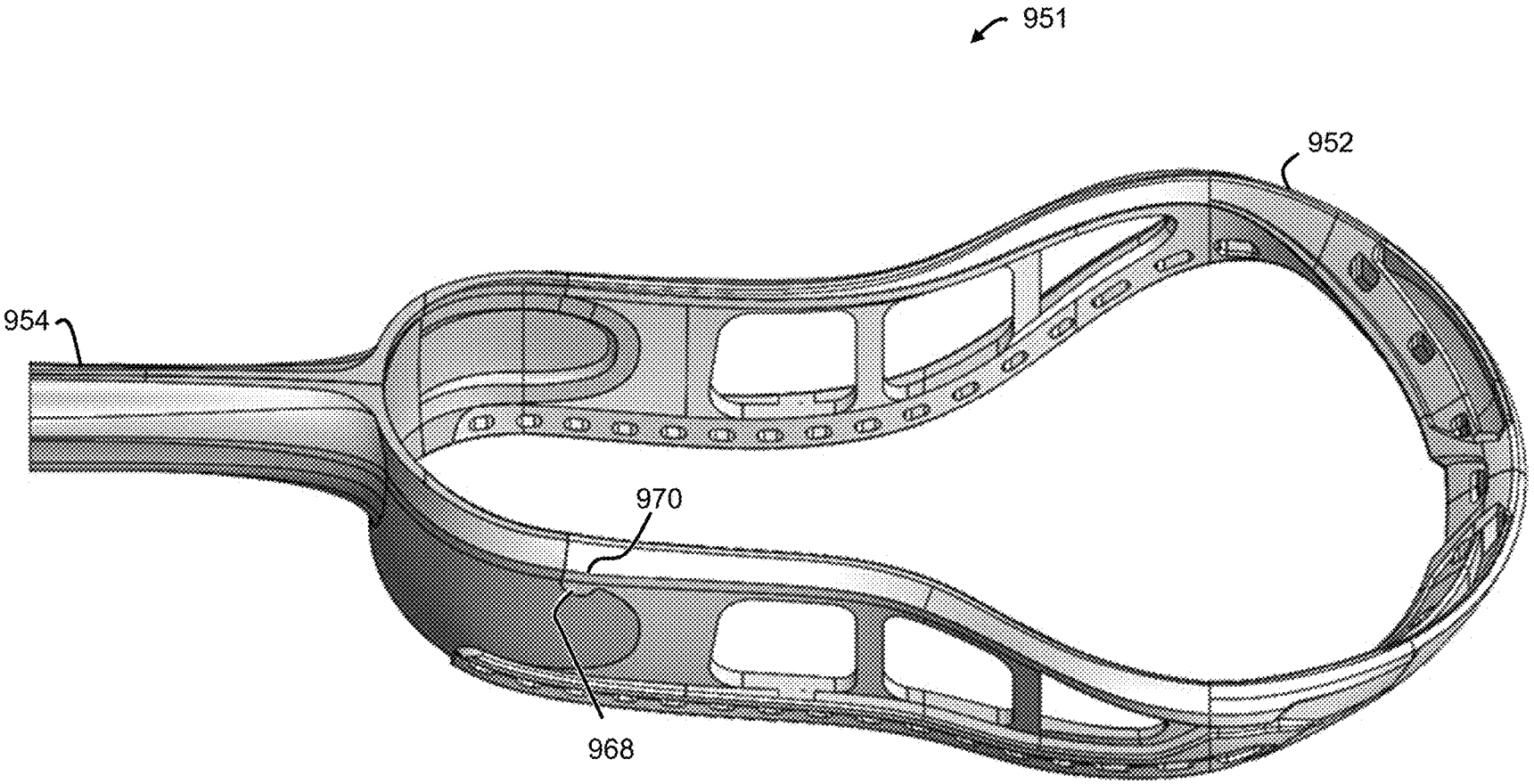
FIG. 23 is a schematic diagram that illustrates a partial perspective view of the lacrosse stick of FIG. 22, shown with the head portion in solid.

An interlocking configuration, such as that of lacrosse stick 950 of FIGS. 19-21, may provide surprising benefits in terms of stress reduction at the connection between a head portion and a juncture-handle portion. The stress reduction may reduce tendencies of a head portion to break away from a juncture-handle portion at a seam at the upper edge of the lacrosse head (e.g., at around the dashed line 965 in FIG. 19). Finite element analysis (FEA) studies on an embodiment similar to the configuration of the embodiment of FIGS. 19-21 demonstrate the stress reduction and the strength of the connection. Referring to FIGS. 22-24, the tested embodiment included a lacrosse stick 951 having a head portion 952 and juncture-handle portion 954 similar to those of the embodiment of FIGS. 19-21, with a similar interlock opening 968 and a similar interlock projection 970, with a less elongated tab 938 and raised edge 962, and with polygonal openings 942 instead of circular.

FIGS. 24.1 and 24.2 illustrate a finite element analysis study of the lacrosse stick 951, according to an embodiment. As shown in FIG. 24.1, the study applied stress to the lacrosse stick 951 by holding the head portion 952 at fixed point 2402 and twisting the juncture-handle portion 954 counterclockwise around its longitudinal centerline. A single 100 lbf-in moment (or twist) was applied to the juncture-handle portion 954 in a counterclockwise direction as represented by the circular arrow 2404. The resulting stress on the structure was then analyzed. As shown in the test results of FIG. 24.2, the internal and external interlocking configuration and the nonlinear seam distributed the stress throughout the juncture-handle portion 954 to prevent high stress regions. In comparison to embodiments having linear seams and larger tab openings (e.g., the embodiment of FIG. 3), the design of tab 938 may redistribute the stress away from the upper edge, as represented by the arrow at Point A. In addition, as represented by the arrow at Point B, the design of tab 938 may move the seam between the head portion 952 and the juncture-handle portion 954, at the upper and lower edges, away from high stress areas of the lacrosse stick head. Thus, for example, the junctions between the plastic of the head portion 952 and the composite material of the juncture-handle portion 954, at the upper and lower edges, are at a more rearward location where stresses on the overall head are lower, so that separation of the plastic and composite materials is less likely. To further avoid such separation, as represented by the arrow at Point C, the design of tab 938 may also provide greater surface area over which the plastic and composite materials may chemically bond, in addition to the internal and external interlocking mechanical connection.

Embodiments may also provide seams and interlocking mechanical connections on the inside (pocket-facing) of a lacrosse head. For example, as shown in FIGS. 20 and 21, the juncture-handle portion 954 may form a raised edge 962, which protrudes from the inner surface of the tab 938 and which the material of the head portion 952 contacts to form a seam. In turn, when viewed from a side view with the front side facing up, the head portion 952 may define a vertically extending base 975 and a horizontally extending arm 977, which may be formed when moldable material of the head portion 952 flows into a space between the tab 938 and walls of a molding tool in which the head portion 952 is molded. Any of the connections discussed herein relative to the outer surfaces of the head portions and juncture-handle portions of a lacrosse head could also be used at the inner surfaces of a lacrosse head. For example, referring to FIG. 20, the interlocking mechanical connection of interlock opening 968 and interlock projection 970 could be used on the inside (pocket-facing) of the head portion 952 and the juncture-handle portion 954.

Figure 25:
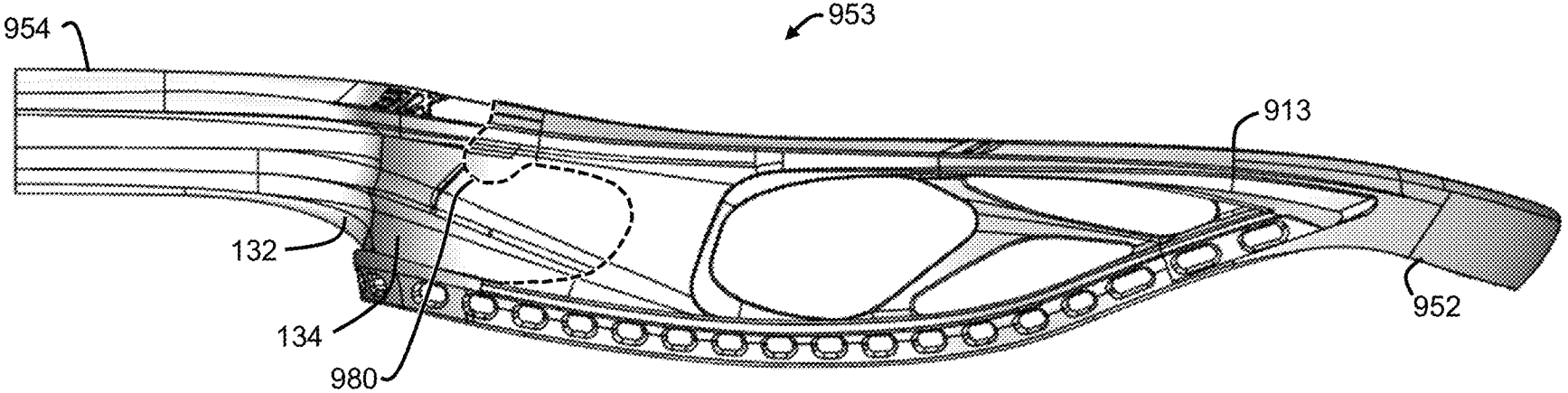
FIGS. 25 and 26 are schematic diagrams that illustrate partial side views of an embodiment of a lacrosse stick having a head portion that overlaps, and extends beyond, an interlocking mechanical connection defined by a raised edge of a juncture-handle portion and adjacent material of the head portion, with the head portion shown solid in FIG. 25 and transparent in FIG. 26 for illustration purposes.
Figure 26:
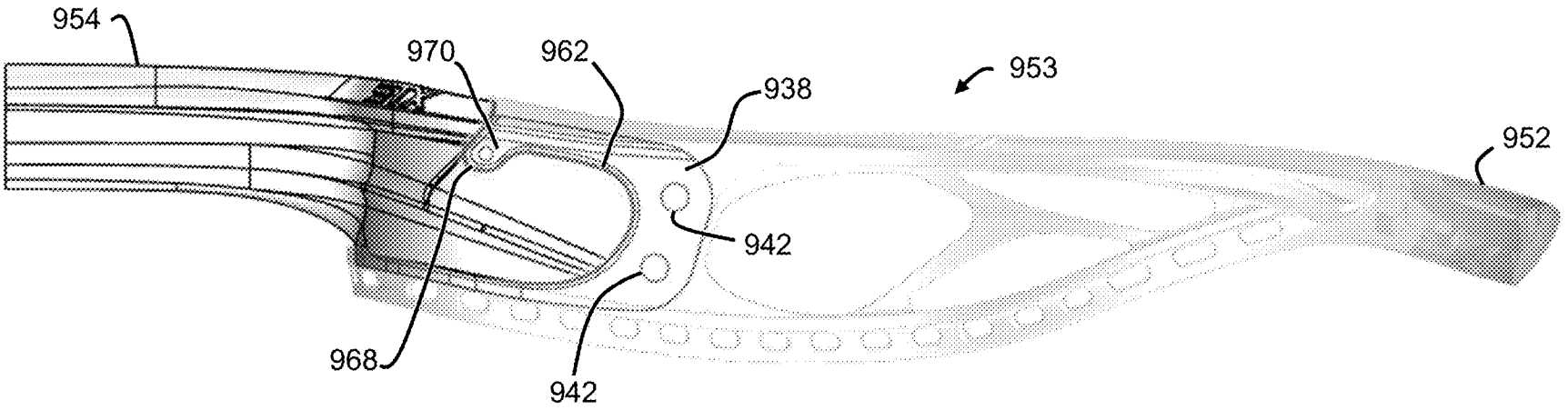

In addition to the structural connections provided by seams and interlocking mechanical connections, embodiments may also include provisions for increasing the area of surface contact—and, thereby, the strength of connection—between a juncture-handle portion and a head portion. As an example, FIGS. 25-30 illustrate an embodiment of a lacrosse stick 953 having seams and interlocking mechanical connections similar to those of the embodiments of FIGS. 19-23 (as indicated by the like reference numerals), but also having a head portion 952 that overlaps, and extends beyond, an interlocking mechanical connection defined by a raised edge 962 of a juncture-handle portion 954 and adjacent material of the head portion 952. FIGS. 25 and 26 illustrate partial side views of the lacrosse stick 953 with the head portion 952 shown solid in FIG. 25 and transparent in FIG. 26. As can be seen by comparing those views, the material of the head portion 952 may extend beyond the raised edge 962 to form a flange 980 (as denoted by the broken line in FIG. 25) that runs along the raised edge 962 and contacts and/or adheres to the outer surface of the juncture-handle portion 954. For illustration purposes, the enlarged partial views of FIGS. 28 and 30 also show head portion 952 transparent, with the flange 980 extending beyond the raised edge 962 and contacting and/or adhering to the outer surface of the juncture-handle portion 954.

Covering the seam and interlocking mechanical connection may increase the strength and durability of the connection between the head portion 952 and the juncture-handle portion 954, for example, by protecting against material separation caused by wear and tear, material fatigue, and objects (e.g., other lacrosse sticks) scraping across a seam. In addition, extending the head portion 952 with the flange 980 may increase the surface contact area and/or the adhesion area between the head portion 952 and the juncture-handle portion 954, which may increase the overall connection strength between the two components. In that regard, the flange 980 may be extended farther over, and adhered to, the outside of the juncture-handle portion 954, toward the juncture 110, and may not necessarily run along the raised edge 962. In embodiments, the flange 980 may extend to the throat member 132 of the juncture-handle portion 954. In other embodiments, the flange 980 may extend all the way around the throat member 132 and be continuous with the flange 980 of the opposite sidewall, to further increase the surface contact area and/or adhesion area between the head portion 952 and the juncture-handle portion 954.

Figure 27:
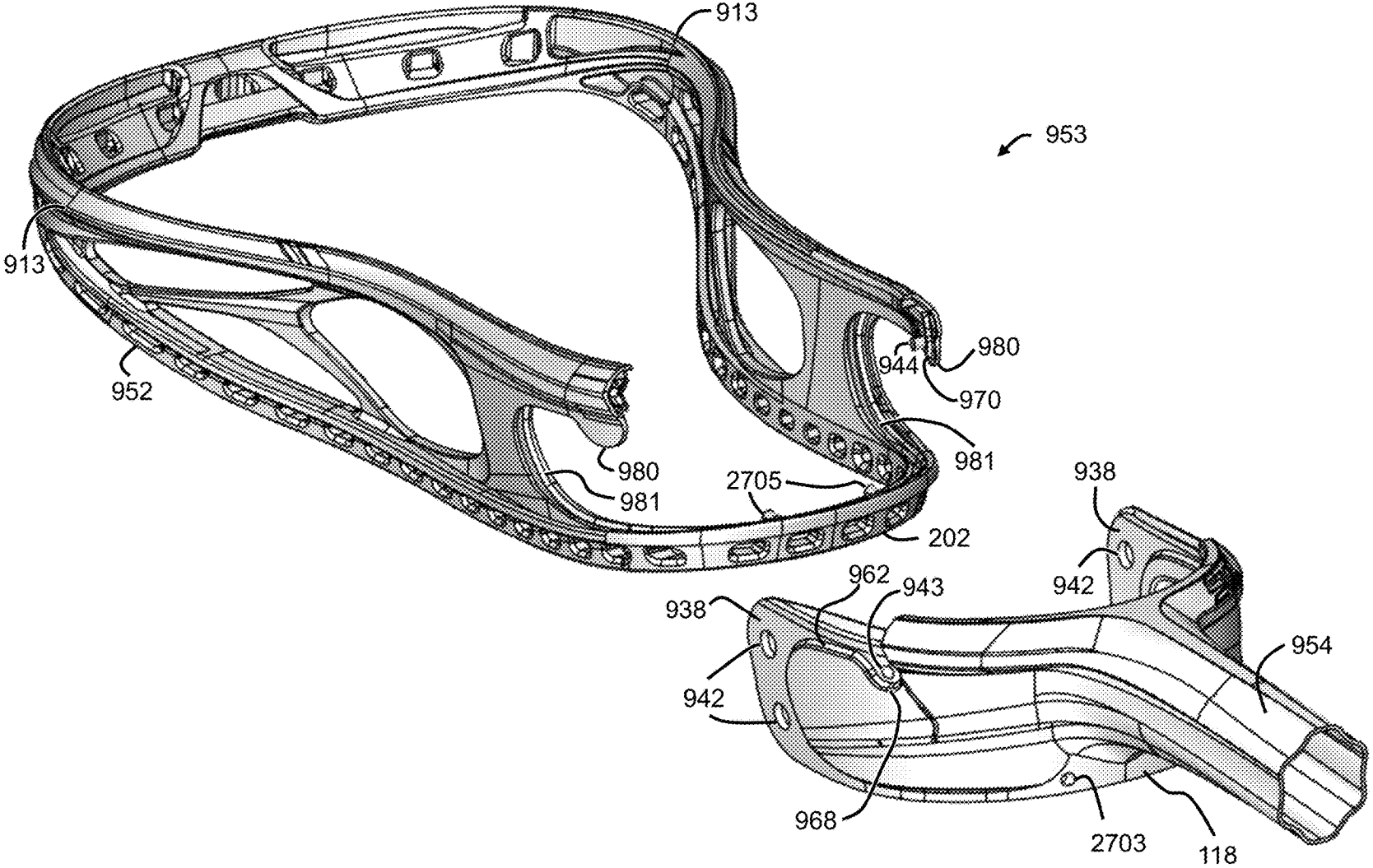
FIG. 27 is a schematic diagram that illustrates an exploded perspective view of the lacrosse stick of FIGS. 25 and 26.
Figure 28:
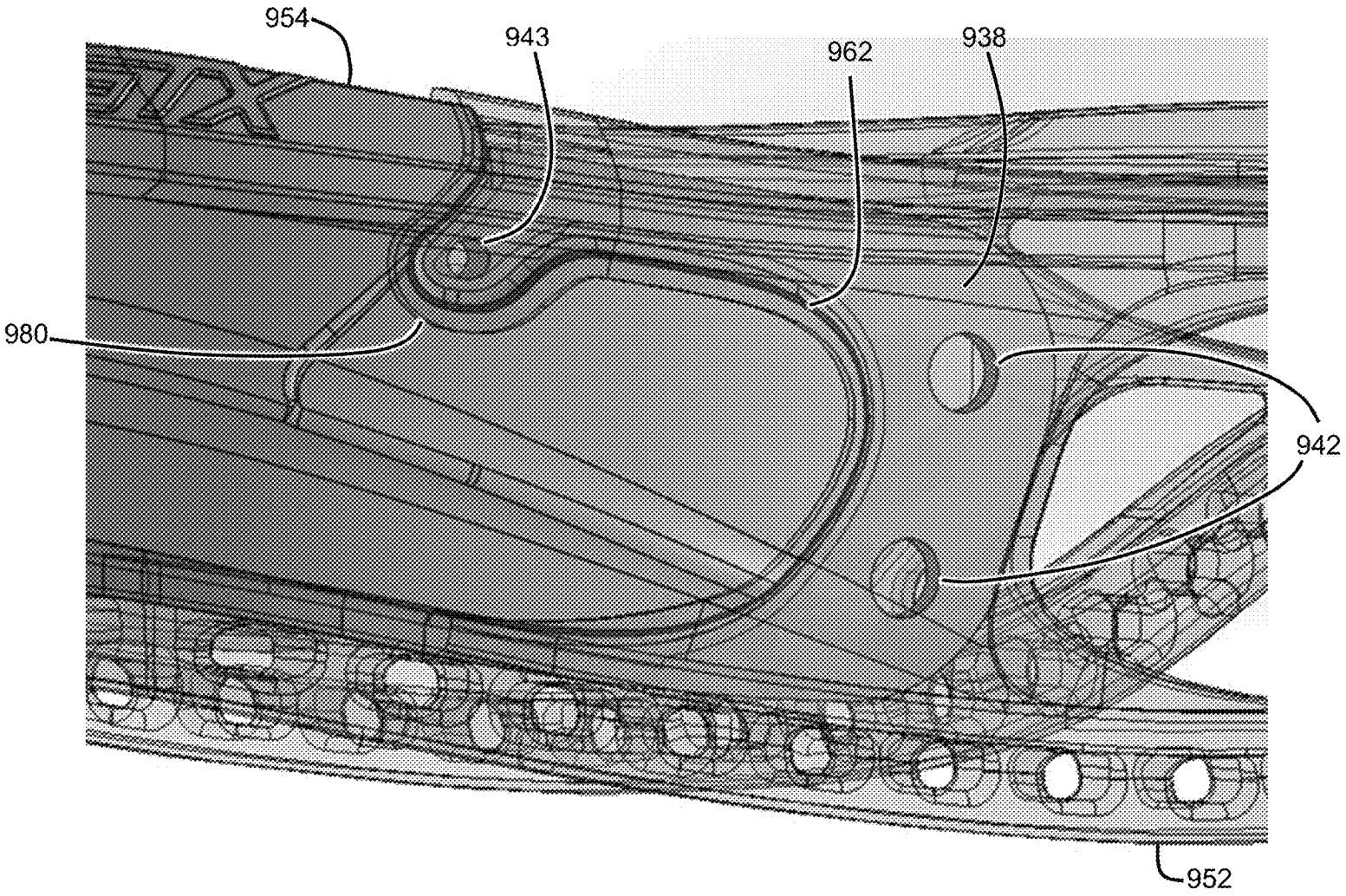
FIG. 28 is a schematic diagram that illustrates an enlarged partial perspective view of the lacrosse stick of FIGS. 25 and 26, with the head portion shown transparent for illustration purposes.

FIG. 27 is an exploded perspective view of lacrosse stick 953, which further illustrates the connections between the head portion 952 and the juncture-handle portion 954, according to embodiments. As shown, the tabs 938 of juncture-handle portion 954 may be disposed within grooves 981 defined by head portion 952. The exploded view of FIG. 27 also shows an example of a post 944 of the head portion 952, which when the head portion 952 and juncture-handle portion 954 are assembled, is disposed within an opening 943 defined by the tab 938 of the juncture-handle portion 954.

Figure 29:
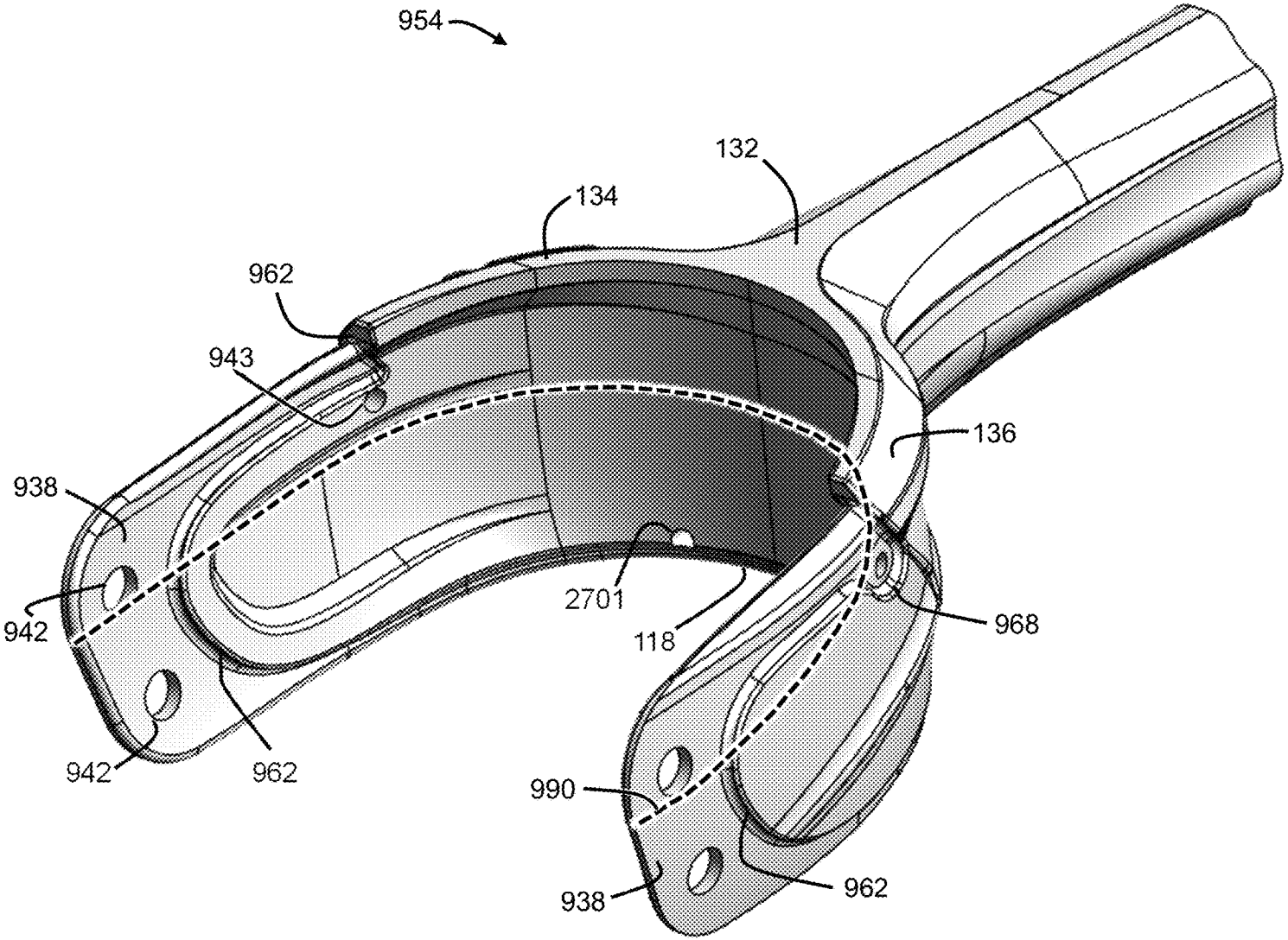
FIG. 29 is a schematic diagram that illustrates a perspective view of the juncture-handle portion of the lacrosse stick of FIGS. 25 and 26.

As shown best in FIG. 29, the raised edges 962 of juncture-handle portion 954 may continue up and over the upper edges of tabs 938 and into the inner surfaces (pocket-facing) of the fork members 134, 138. At any of the points along the raised edges 962, the material of head portion 952 may stop at the raised edges 962 and form a seam, or may extend beyond the raised edges 962 in an overlapping configuration, which may form a flange. In embodiments, on the inner surfaces of the fork members 134, 138, the material of the head portion 952 may stop at the raised edge 962 and be flush with the raised edge 962 to provide a smooth transition, which may avoid impacting the travel and control of a lacrosse ball within the head of the lacrosse stick 953. In other embodiments, in the inner surfaces of the fork member 134, 138, the material of the head portion 952 may overlap the raised edge 962 to form a flange and/or to adhere to a larger area of the inner surfaces, which may provide a stronger, more durable connection. In embodiments, a flange may be tapered, for example, starting at the raised edge 962 and decreasing in thickness as it extends over the juncture-handle portion 954, to provide a minimal edge at its end.

In addition to, or as an alternative to, the external interlocking connections at the upper edge of a lacrosse head of the embodiments of FIGS. 19-23 and 25-30, other embodiments may provide interlocking connections at the lower edge of the lacrosse head or in between the upper and lower edges. In addition, although the embodiments of FIGS. 19-23 and 25-30 have an interlock opening 968 on the juncture-handle portion 954 and an interlock projection 970 on the head portion 952, other embodiments may reverse the configuration and have the juncture-handle portion 954 define an interlock opening and the head portion define the interlock projection.

Although embodiments described herein, such as the embodiments of FIGS. 1-7, illustrate connections between the juncture-handle portion 104 and head portion 102 disposed in the rearward half of head 108, the connections may be positioned anywhere from the stop member 118 to the transverse wall 116. For example, in embodiments providing stiffer sidewalls, a connection could be disposed in the forward half of head 108 at the shoulders 113 (see FIG. 2) where the head 108 transitions from the sidewalls 112, 114 to the transverse wall 116. In addition, the positions and dimensions of a seam and a protruding tab could vary to provide desired sidewall stiffness. For example, referring to FIG. 6, tab 138 (shown visible through head portion 102) may be extended to reach farther forward inside head portion 102 to provide a stiffer sidewall 114. The length, width, and thickness of a tab can therefore vary to achieve a desired stiffness. Additionally, the connections on opposite sides of a head 108 may be symmetrical as shown in the embodiments of FIGS. 1-6, or may be asymmetrical to provide different performance characteristics on each side of a head.

With respect to the length of the tabs, the inventors have determined ranges that lead to surprising benefits in providing strong, durable connections between a juncture-handle portion and a head portion, and avoiding high stress areas of a lacrosse head frame. Referring to the partial front view at the top right of FIG. 4, for example, the length of the tabs may be defined by an arc length starting at the forward distal end of first tab 138, continuing around the first fork member 134, the throat member 132, and the second fork member 136, and ending at the forward distal end of second tab 140.

The arc length may be disposed within a horizontal plane generally parallel to the longitudinal centerline when viewing the lacrosse head from a side view. In embodiments, the arc length may be at least 100 mm for a men's lacrosse head constructed in accordance with Rule 1 and Appendix IV of the NCAA Men's Lacrosse 2021 and 2022 Rules Book, which is herein incorporated by reference in its entirety. Referring to FIGS. 25-30, one embodiment may provide, as represented by the dashed line 990 in FIG. 29, an arc length 990 of approximately 200 mm for a men's lacrosse head constructed in accordance with the NCAA Men's Lacrosse 2021 and 2022 Rules Book. In embodiments, the arc length 990 may be within a range of about 100 mm to about 300 mm, being at least about 100 mm to provide a strong, durable connection between a juncture-handle portion and a head portion, and equal to or less than about 300 mm so as not to adversely affect a desired flexibility of the forward portion of the lacrosse head. For players desiring less flexibility in the forward portion of a men's lacrosse head, embodiments may provide an arc length 990 of about 440 mm, which may reach the shoulders of the lacrosse head frame (see, e.g., shoulders 913 in FIGS. 25 and 27) to provide stiffer sidewalls, while leaving a flexible transverse wall beyond the shoulders.

In other embodiments, the length of the tabs may be defined proportionally relative to the length of the lacrosse head. Referring to FIGS. 2 and 4, for example, the tabs may be defined as extending in a forward direction from the stop 118 a length 163 that is proportional to a length 161 of the overall lacrosse head measured along the bisecting line 119 (when viewing the head from front view) from the stop 118 to the distal forward edge of the transverse wall 116. As shown in FIG. 4, when viewed from a front view, the forward end of tab length 163 may be defined by a line 165 generally perpendicular to the bisecting line 119. Based on those defined relative lengths, in an embodiment, tab length 163 may be equal to or greater than about 9 percent of the overall lacrosse head length 161, to provide a strong, durable connection between a juncture-handle portion and a head portion. In one implementation, referring to FIGS. 25-30, the arc length 990 may be about 100 mm, the overall lacrosse head length 161 may about 258 mm, and the tab length 163 may be about 23 mm, or about 9 percent of length 163. In other embodiments, a tab length 163 may be equal to or greater than about 10 percent of overall lacrosse head length 161.

Embodiments may also include provisions for attaching a pocket to a head portion of a lacrosse stick. For example, as shown in the embodiments of FIGS. 1, 2, 4, and 6, sidewalls 112, 114 and transverse wall 116, may define stringing openings 122, 124, which may be formed by the moldable material of head portion 102. Additional stringing openings in the ball stop 118 (not shown in FIGS. 1, 2, 4, and 6) may be defined by the juncture-handle portion 104, for example, by forming holes with layups, by applying layups around inserts, or by drilling, cutting, ablating, or otherwise forming openings through an already-formed juncture-handle portion.

Figure 10:
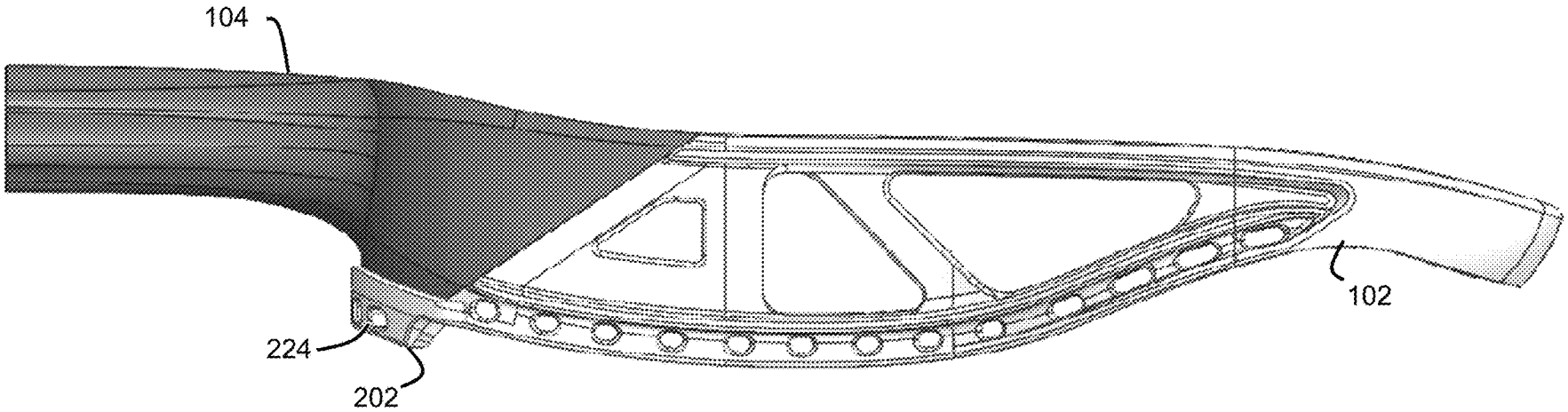
FIG. 10 is a schematic diagram of a partial side view of a lacrosse stick according to another embodiment, having a head portion with a ball stop stringing member.
Figure 11:
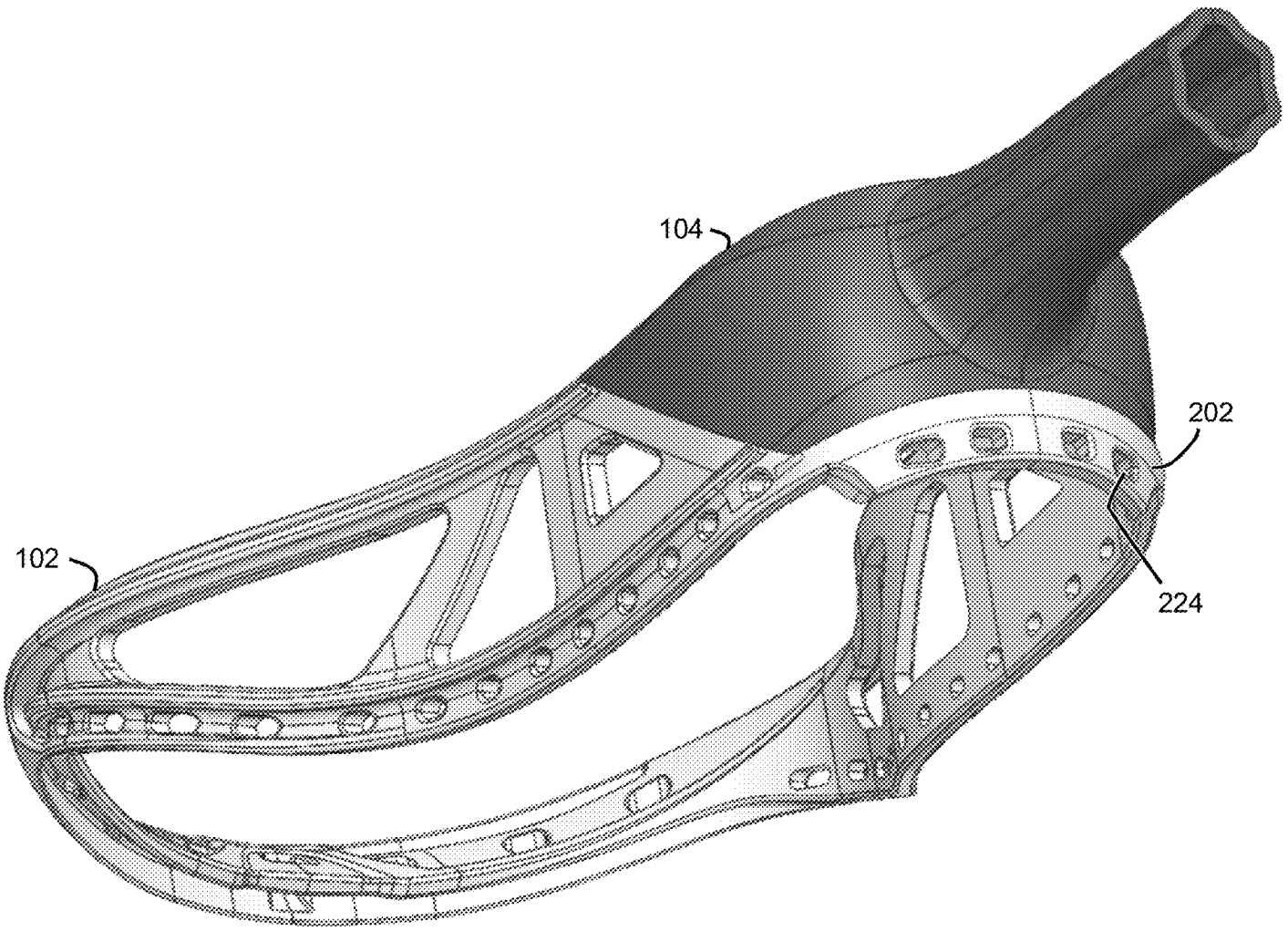
FIG. 11 is a schematic diagram of a partial, back perspective view of the lacrosse stick of FIG. 10.
Figure 12:
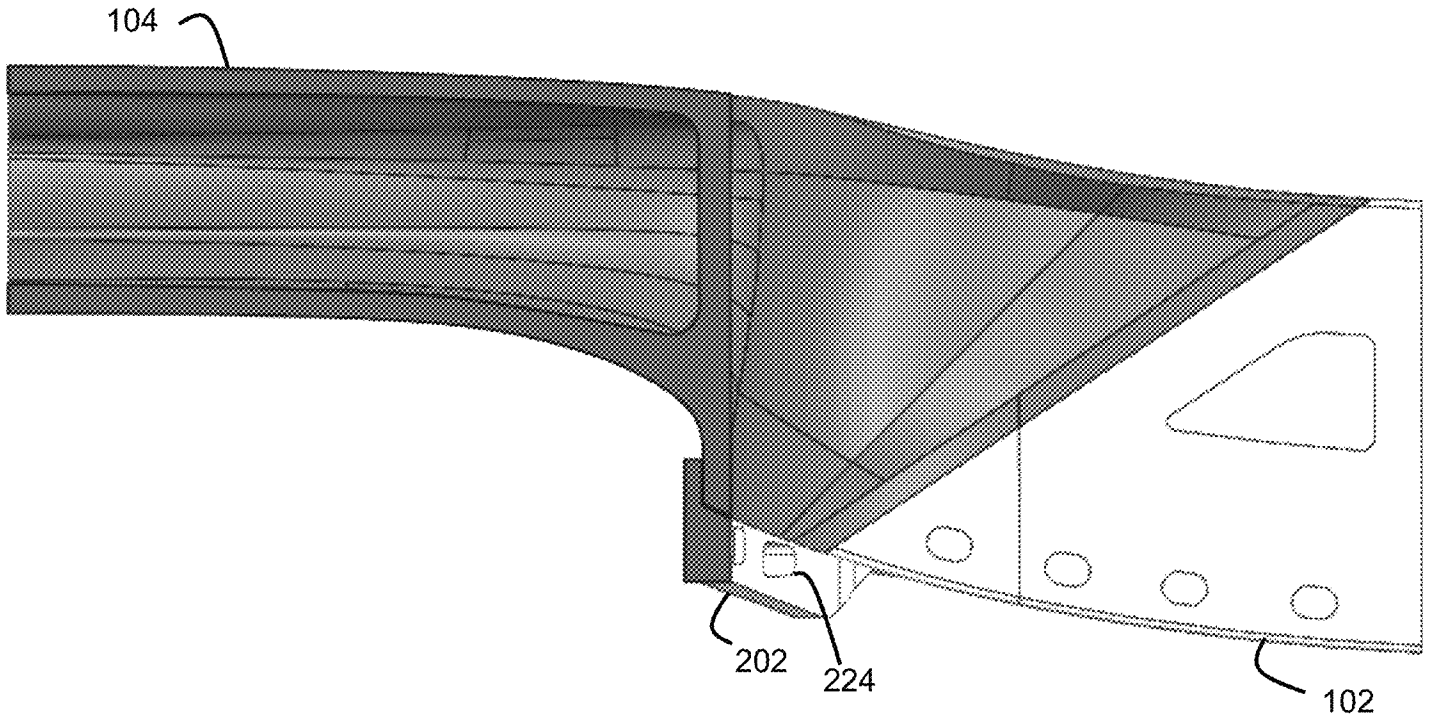
FIG. 12 is a schematic diagram of a partial cross-sectional view of the lacrosse stick of FIG. 10, taken along the longitudinal bisecting line of the head portion.

To simplify construction and manufacturing, and avoid possible weaknesses around holes in a composite material, alternative embodiments may include provisions for forming ball stop stringing openings with the moldable material of a head portion. For example, as shown in FIGS. 10-12, an embodiment may extend head portion 102 to form a ball stop stringing member 202 on a lower edge of the stop member 118 of juncture-handle portion 104. Ball stop stringing member 202 may define stringing holes 224, which may receive thongs, for example. As shown in the cross-sectional view of FIG. 12, the moldable material of head portion 102 may overlap the composite material of the juncture-handle portion 104 to form the ball stop stringing member 202. The addition of the ball stop stringing member 202 may provide a continuous structure around the frame of head 108, which may allow for a sturdy and durable anchor for a pocket.

Figure 30:
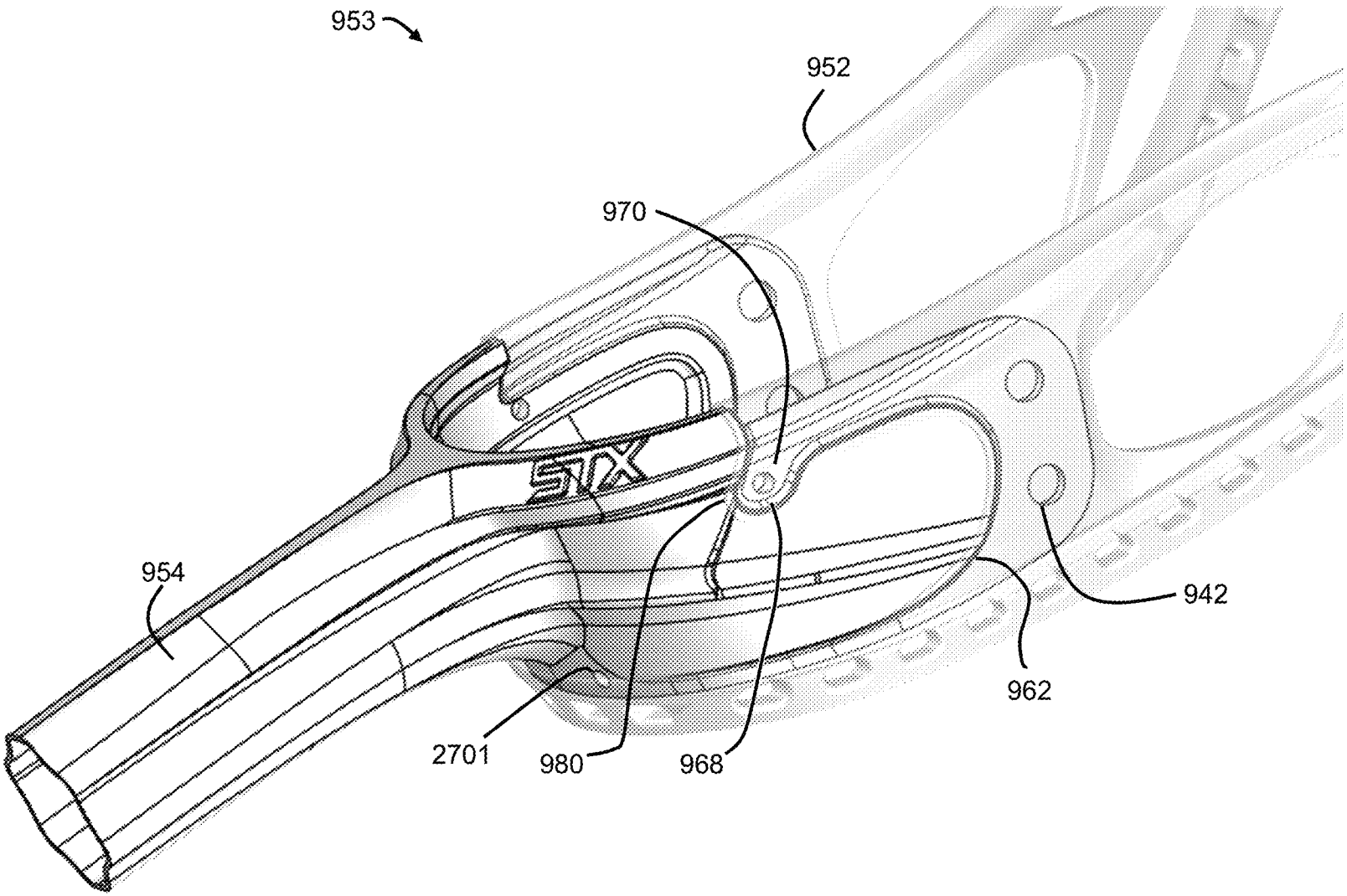
FIG. 30 is a schematic diagram that illustrates a partial perspective view of the lacrosse stick of FIGS. 25 and 26, with the head portion shown transparent for illustration purposes.
Figure 31:
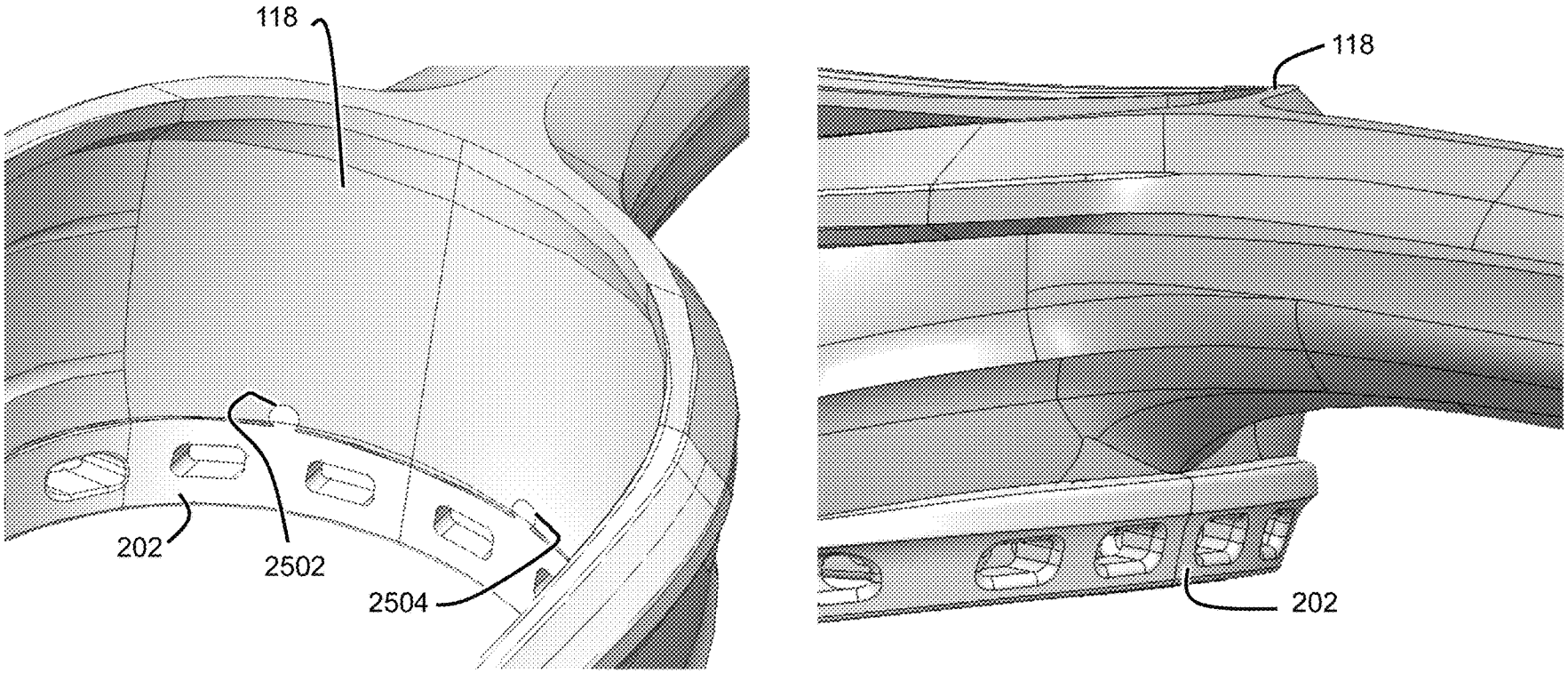
FIGS. 31 and 32 are schematic diagrams that illustrate partial perspective views of a stop member with openings through which moldable material of a ball stop stringing member (shown solid in FIG. 31 and transparent in FIG. 32) may be disposed, according to an embodiment.
Figure 32:
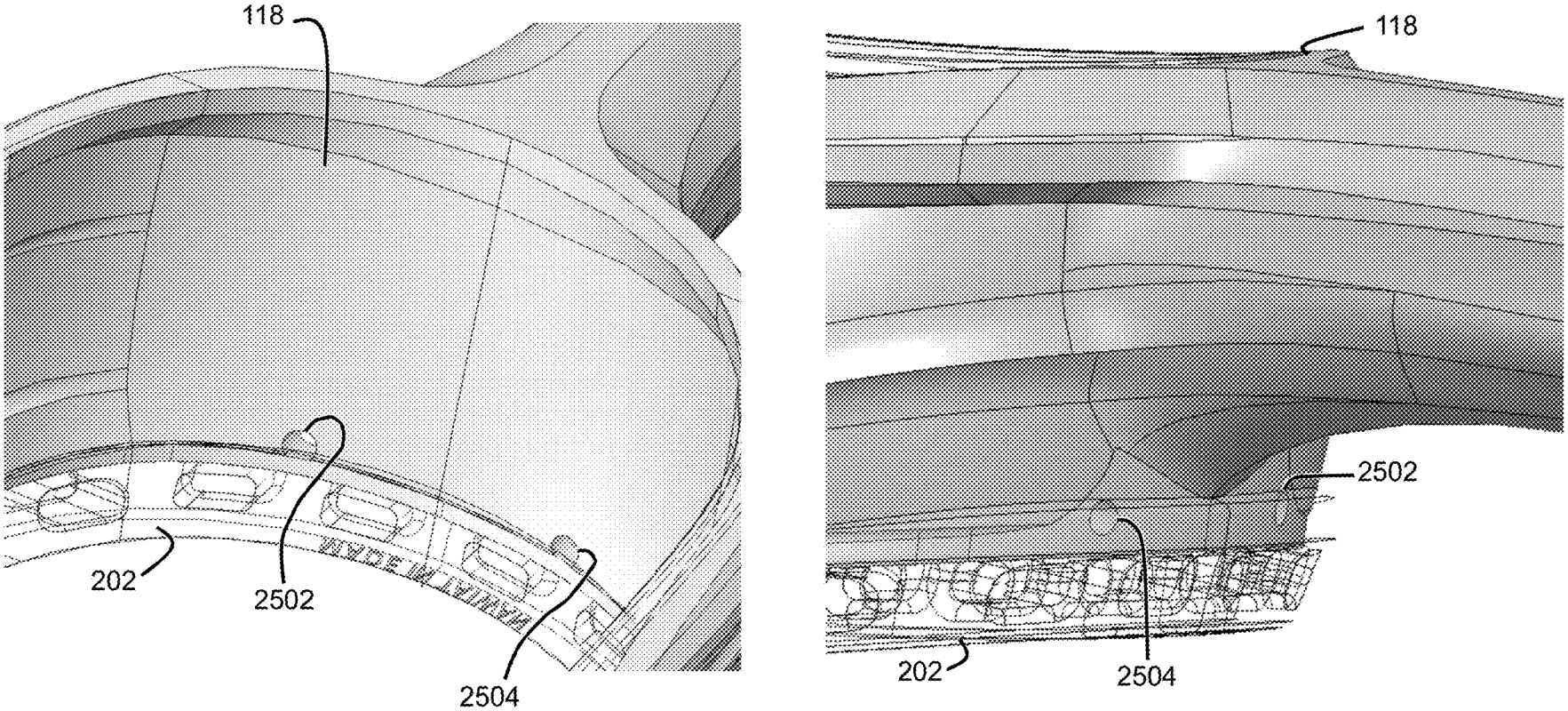

In addition to, or as an alternative to, the overlapping configuration of FIG. 12, other embodiments may provide holes, windows, and/or tabs at the lower portion of the stop member 118 of the juncture-handle portion 104, through which the moldable material of the ball stop stringing member 202 may be disposed. For example, referring to FIG. 3, fiberglass ply stackup 146 could include tabs protruding from the lower edge 170 of stop member 118, similar to the protruding tab 138. As another example, FIGS. 31-32 illustrate a stop member 118 with openings 2502, 2504 through which moldable material of a ball stop stringing member 202 (shown solid in FIG. 31 and transparent in FIG. 32) may be disposed to provide a strong, durable mechanical connection, in addition to the chemical bond between the moldable material and the material of the juncture-handle portion 104. As another example, FIGS. 27, 29, and 30 illustrate a stop member 118 with openings 2701, 2703 through which moldable posts 2705 of a ball stop stringing member 202 may be disposed. These types of openings and protrusions may increase the strength of the mechanical and/or chemical connection between the ball stop stringing member 202 and the juncture-handle portion 104, to enhance the durability of a lacrosse head.

Embodiments may also include methods for manufacturing lacrosse sticks, which may achieve the aspects of weight, balance, hand-placement, and durability described above. An embodiment may employ a two-phase manufacturing approach. The first phase may form the shaft portion and the juncture-handle portion into a single component. The second phase may add the head portion to the joined shaft and juncture-handle portions, to provide a complete lacrosse stick. Alternatively, if a separate extended shaft portion is desired (e.g., made of a different material, such as metal), then the first phase may form just the juncture-handle portion, and the second phase may add the head portion to the juncture-handle portion, after which the separate extended shaft portion may be attached to the handle portion of the juncture-handle portion to provide a complete lacrosse stick.

Figure 13:
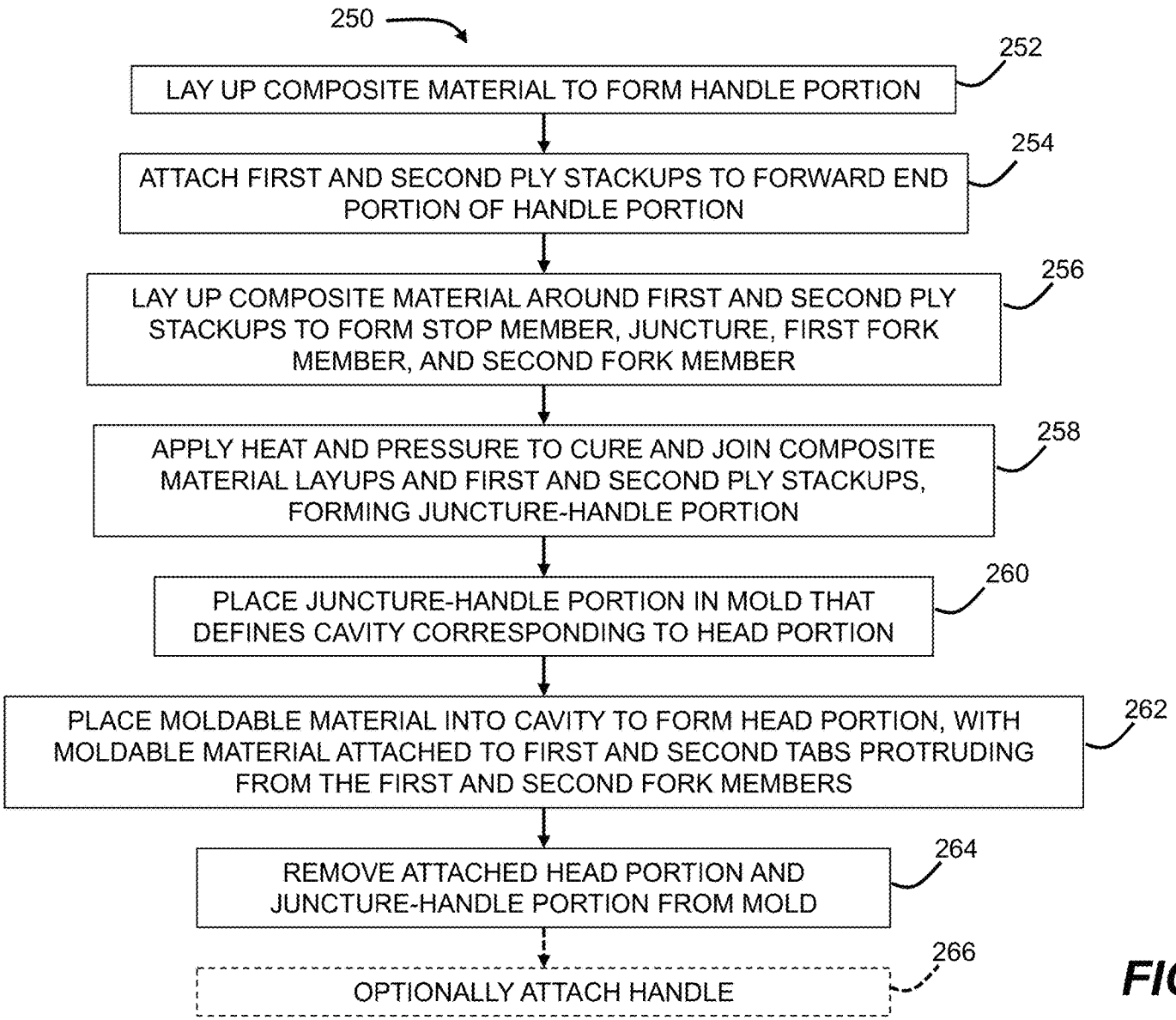
FIG. 13 is flowchart illustrating a method for manufacturing a lacrosse stick according to an embodiment.

FIG. 13 illustrates a method 250 for manufacturing a lacrosse stick according to an embodiment. As shown, method 250 may begin in step 252 by laying up composite material to form a handle portion. The handle portion may have a rearward end portion and a forward end portion. In embodiments not involving a separate extended shaft portion, this step may include forming the extended shaft portion with the handle portion.

Method 250 may then continue in step 254 by attaching a first ply stackup to a first side of the forward end portion of the handle portion and a second ply stackup to a second side of the forward end portion of the handle portion. The first and second ply stackups may be stiffer than the composite material layup.

In step 256, method 250 may continue by laying up composite material around the first and second ply stackups to form a stop member, a juncture, a first fork member, and a second fork member. The first ply stackup may define a first tab protruding from the first fork member and the second ply stackup may define a second tab protruding from the second fork member.

Method 250 may then continue in step 258 by applying heat and pressure to cure and join the composite material layups and the first and second ply stackups, forming a juncture-handle portion (and an extended shaft portion, if included).

In step 260, the juncture-handle portion (and extended shaft portion, if included) may be placed in a mold that defines a cavity corresponding to a head portion of the lacrosse stick. The cavity may enclose the first tab and the second tab.

In step 262, moldable material may be placed into the cavity to form the head portion. The moldable material may flow around and attach to the first tab and the second tab.

In step 264, the attached head portion and juncture-handle portion (and extended shaft portion, if included) may be removed from the mold.

Optionally, in embodiments in which an extended shaft portion is not included, method 250 may continue in step 266 by attaching an extended shaft portion to complete the lacrosse stick.

Figure 14:
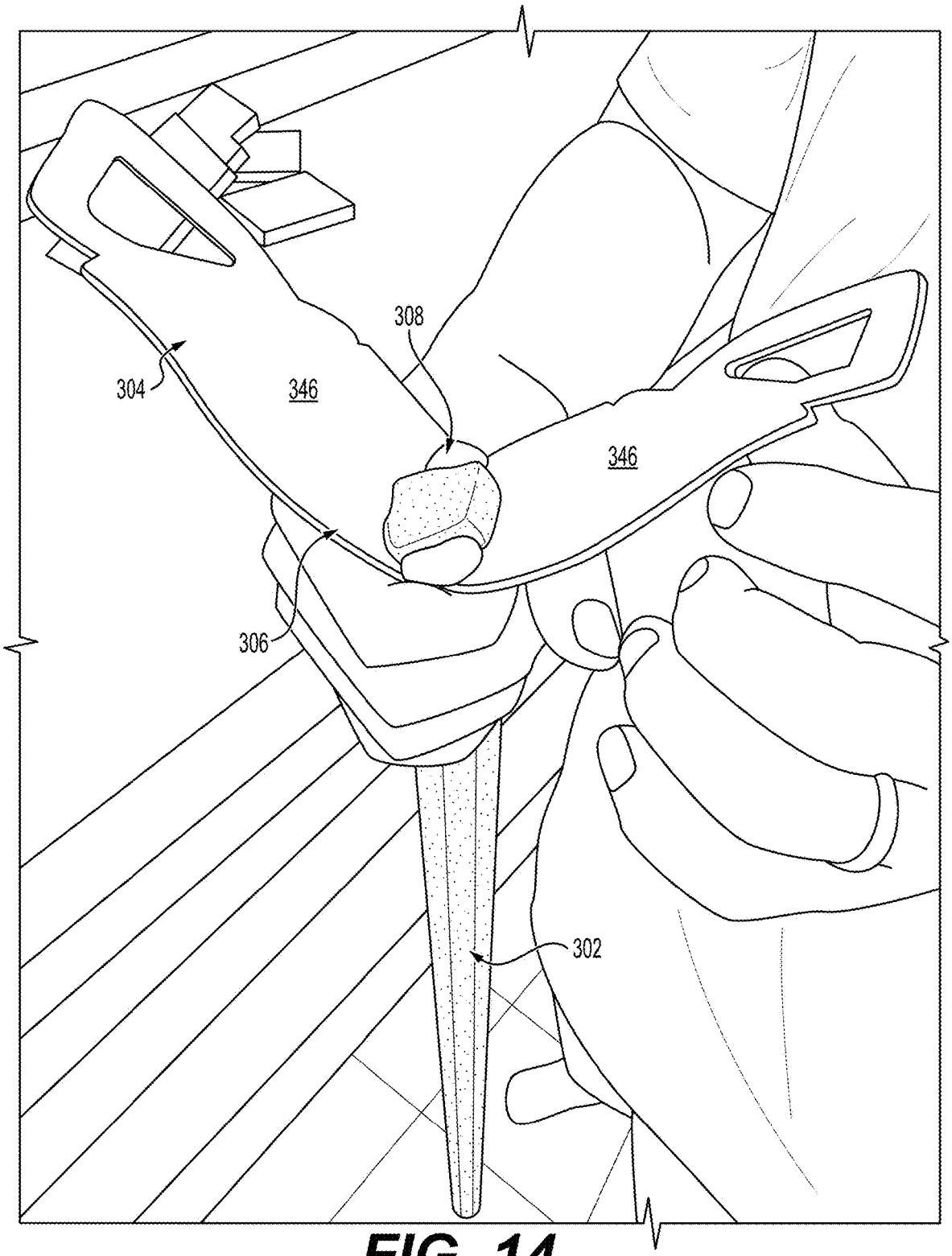
FIGS. 14-16 are images of a method for making a lacrosse stick according to an embodiment.
Figure 15:
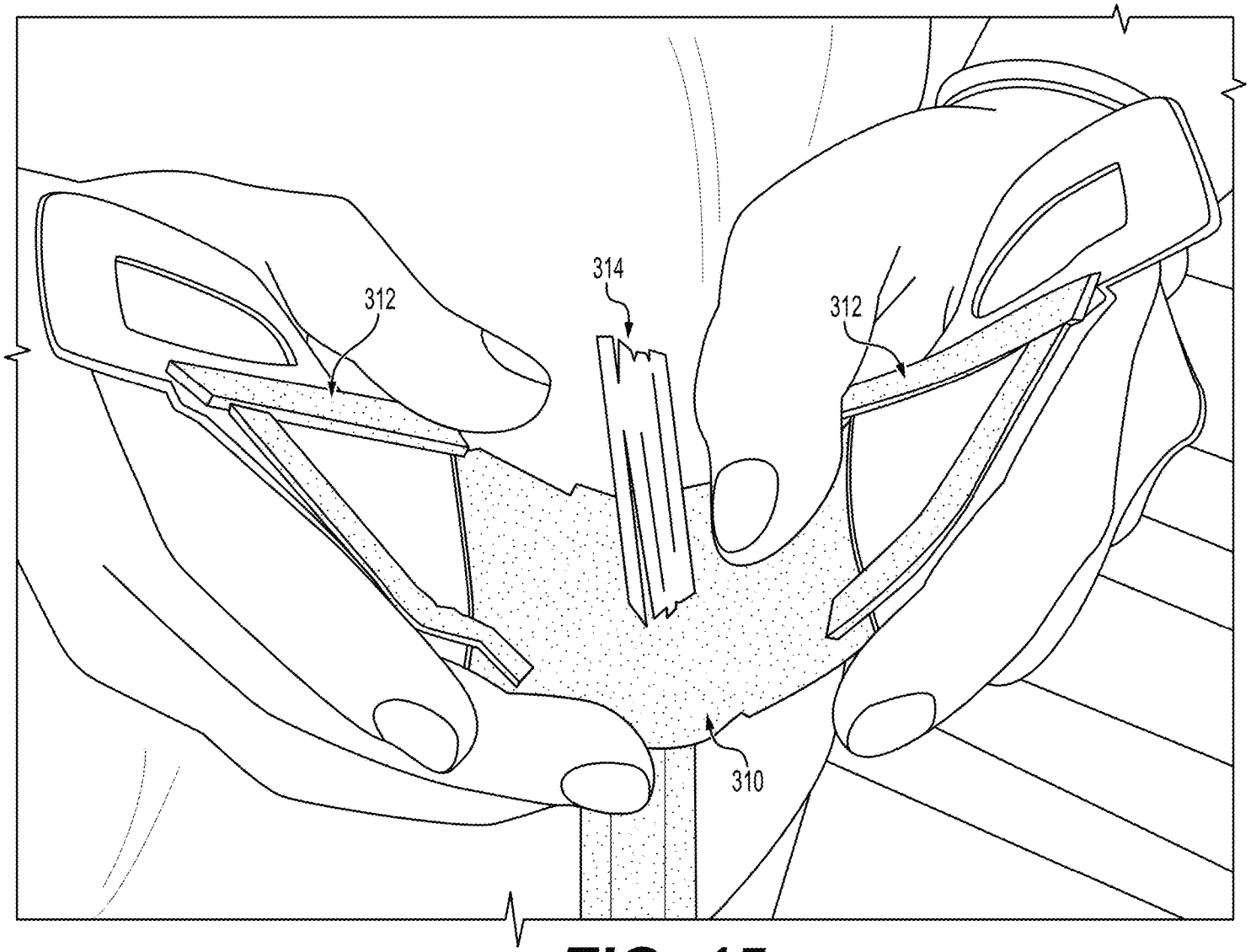
Figure 16:
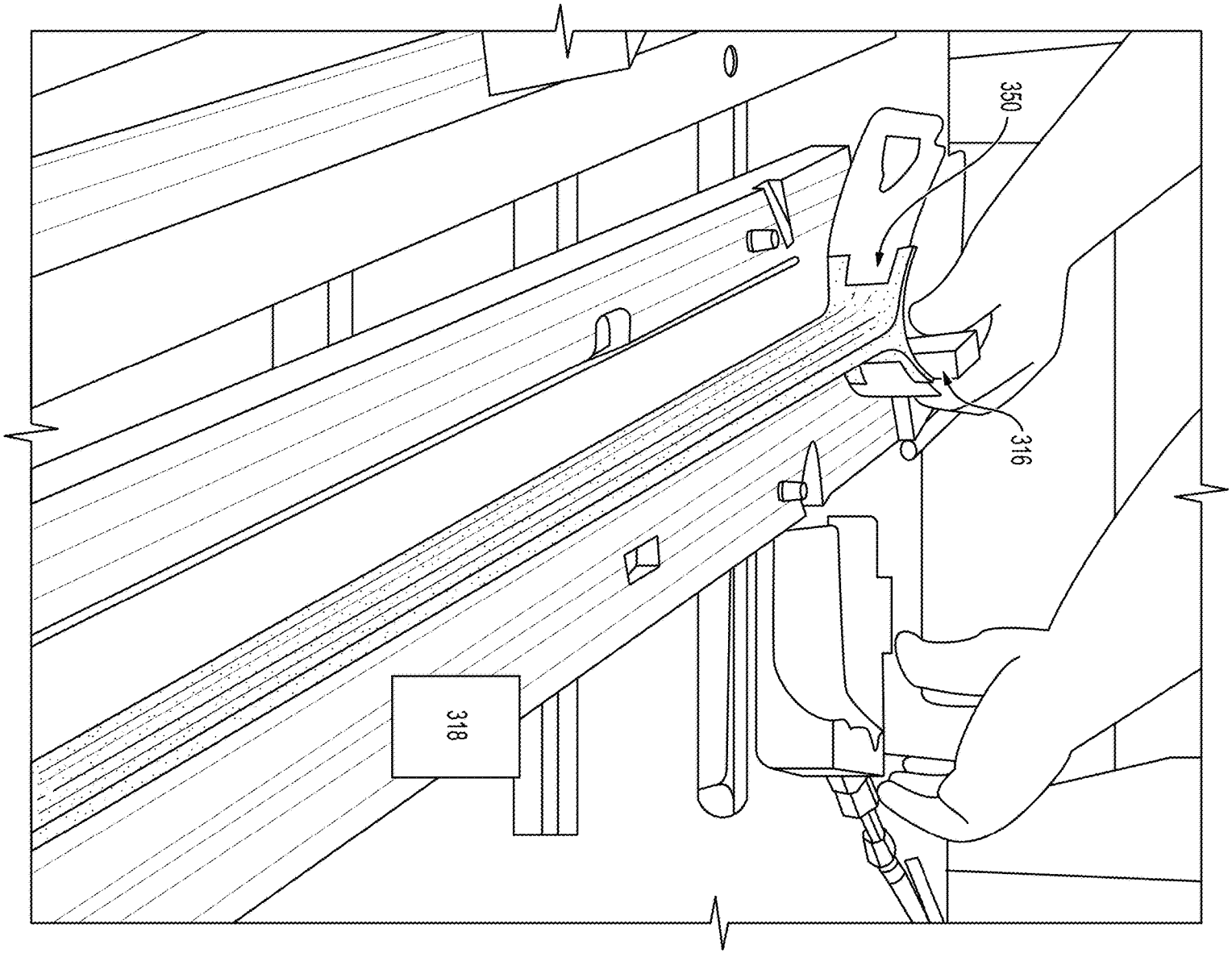

To illustrate a particular implementation of the first phase described above, with the extended shaft portion included, FIGS. 14-16 illustrate a method for manufacturing a shaft portion and juncture-handle portion of a lacrosse stick. As shown, starting with FIG. 14, the method may begin in step 302 by laying up the shaft portion and the handle portion of the juncture-handle portion with unidirectional carbon and fiberglass material using roll wrapping or other layup methods. The shaft/handle portion layup may remain uncured at this point. In an embodiment, fewer layups may be applied at the forward end (where the head attaches) to provide a tapered, smaller thickness, which may accommodate added material of the juncture-handle portion, maintain a substantially constant thickness along the length of the shaft and handle portions, and allow for a smoother transition to the juncture-handle portion, as further described below.

The method may then continue in step 304 by cutting fiberglass fork plies and laying them up. In one embodiment, at least ten fiberglass fork plies are laid up, where one layer of composite material is considered to be a ply. As shown in FIG. 14, each fiberglass fork ply may be cut into a desired shape that provides a tab and a reinforcement structure through one side of the juncture-handle portion. FIG. 14 shows two fiberglass ply stackups 346, which may be similar to the stackups 146 described above with reference to FIG. 3.

With the stackups 346 formed, the method may continue in step 306 by attaching the uncured fiberglass ply stackups 346 to the uncured shaft and handle portion plies. In embodiments, the stackups and plies, in their uncured conditions, may be sticky so as to facilitate their attachment to each other. In addition, in some embodiments, at the end location of the shaft and handle portions at which the stackups 346 are attached, there may be fewer plies of the shaft and handle portions so that the thickness of the shaft and handle portions remains constant along the entire length and so as to provide a smooth transition between the shaft portion and the juncture-handle portion. To further secure the connection, additional layers of unidirectional carbon and fiberglass material may be applied to the outside of the forward end of the handle portion and to the outside of the stackups 346, which can be seen in FIG. 16, as indicated by arrow 350. These additional layers may enclose the stackups 346 along the handle portion 130 and throat member 132 of the juncture-handle portion 104 (see, e.g., FIG. 3).

With stackups 346 secured to the shaft and handle portions, as shown in FIG. 14, the method may continue in step 308 by adding filler material at the end of the handle portion. The filler material may be in contact with the stackups 346. As shown in the example of FIG. 14, a first clump of filler material may be placed next to the handle portion at an upper side of the stop member, and a second clump of filler material may be placed next to the handle portion at a lower side of the stop member. The filler material may be, for example, an epoxy-based filler material. In embodiments, the mass of the filler material may be selected to provide a lacrosse stick with a desired balance, as represented by the arrow 160 in FIG. 1. The filler material mass may therefore depend on, for example, the mass and locations of the composite layups of the shaft portion and the juncture-handle portion, and the mass and locations of the moldable material of head portion 102. A balance point of a lacrosse stick may therefore be adjusted by varying the layups and/or filler material. In embodiments, the filler material may also strengthen the stop member of the juncture-handle portion.

Referring now to FIG. 15, with the filler material in place, the method may continue in step 310 by applying one or more layers of carbon fiber material at the top of the handle portion to cover the end of the handle portion and the filler material, and to provide further reinforcement for the stop member of the juncture-handle portion. As shown, the layer(s) of carbon material may have a rectangular shape.

For additional reinforcement, the method may further include applying additional reinforcing plies along the fork members, as shown in step 312. As shown in the example of FIG. 15, the additional plies may be elongated strips positioned in a triangular configuration. The plies may be randomly oriented carbon fiber. Other configurations of reinforcing plies are possible, to provide a desired amount of reinforcement.

As show in step 314 of FIG. 15, the method may optionally include applying additional fiberglass reinforcement. Overall, through steps 310 to 314, the fork members may be "tuned" in terms of stiffness and durability, by adjusting, for example, the fiber layup, direction, and material composition.

Referring now to FIG. 16, with all of the uncured layup materials in place, the method may continue in step 316 by placing the assembled components into a bottom side of a clamshell mold tool. As shown, in this example, the tool may include an inner support inside the fork members and also an outer pressure support around the fork members. The tool may therefore pressurize the fork members in two directions.

After the supports are in place at the top of the shaft and handle portions, the method may then continue in step 318 by lowering the top side of the clamshell mold tool onto the part and placing the tool into an oven to cure.

After curing, the now joined shaft and juncture-handle portions are removed from the tool, having a structure generally corresponding to the juncture-handle portion 104 and shaft portion 106 of FIG. 1, without the head portion 102. To complete the manufacture of the lacrosse stick, the assembled shaft and juncture-handle may be placed in an injection mold tool that forms a cavity around the juncture-handle portion corresponding to the head portion. Moldable material, such as plastic, may be injected into the cavity to mold the head portion onto the juncture-handle portion.

Although FIGS. 14-16 illustrate a method in which the handle portion of the juncture-handle portion is formed as a full-length shaft portion with composite layups, other embodiments may form just a short handle portion of the juncture-handle portion using composite layups. A separate handle may then be attached to the handle portion to provide the full-length shaft portion.

To facilitate molding of a head portion to a juncture-handle portion, and to improve the strength and durability of the connection between the two components, embodiments may include additional provisions for promoting a chemical bond between the materials of the components. For example, embodiments may incorporate into both components a common material, or two materials that are compatible with each other. This approach may make the materials of the head portion and the juncture-handle portion more likely to chemically bond to provide a stronger, more durable connection.

One embodiment may form a juncture-handle portion using commingled thermoplastic/carbon fibers having, instead of a typical epoxy resin, a plastic resin that is the same as, or similar to, the resin from which the head portion is molded. The resin may be, for example, nylon 6 resin, or PA6 (polyamide 6) material. In this manner, the polymer of the juncture-handle portion and the polymer of the head portion would be the same (e.g., a PA6 material) and would strongly bond to each other. In one implementation, the material of a head portion may be PA6 (ST801) nylon and the material of a juncture-handle portion may be commingled fiber including carbon fiber (e.g., H EXCEL AS4C™ 3K unsized), thermoplastic fiber (PA6 fiber, 12.5 DPF, unsized), and thermoplastic resin (e.g., BASF ULTRAMID 27™ E 01 Polyamide 6, by BASF Polyamides and Intermediates of Freeport, Texas). In an embodiment, the commingled fiber, based on nominal raw material values, may have Denier (gms/9 kmtrs) values of 1800 for carbon, 900 for PA6, and 2700 total; Dtex (gms/10 kmtrs) values of 1998 for carbon, 999 for PA6, and 2997 total; Yield (yds/lb) values of 2480 for carbon, 4961 for PA6, and 1654 total; Weight Percent values of 66.7% carbon and 33.3% PA6; Specific Gravity values of 1.79 for carbon and 1.14 for PA6; Volume Percent values of 56.0% carbon and 44.0% PA6; a Sizing Level (%) of 0.5-1.5; and a Sizing Type of PA6 compatible sizing.

In FIG. 17, Table 1 compares material characteristics of an Epoxide juncture-handle portion (second column from right) to a PA6 Ultramid B27 juncture-handle portion (right column), relative to a PA6 ST801 lacrosse head. As shown, a closer correlation exists between the characteristics of the PA6 lacrosse head and the PA6 juncture-handle portion than between the PA6 lacrosse head and the Epoxide juncture-handle portion. That closer correlation may provide better compatibility and a stronger and more durable junction.

Overall, the structures and manufacturing methods described herein may provide a lacrosse stick with improved performance characteristics, including lighter weight, tuned balance, optimal hand-placement, and increased durability. The composite construction of a juncture-handle portion may provide stiff, non-degenerative flex that resists warping; on the other hand, the molded-material (e.g., plastic) construction of a head portion may be flexible, forgiving, and durable. The composite constructions may also facilitate the adjustment of the balance of a lacrosse stick, by changing the mass and locations of the carbon fiber layups, fiberglass layups, and/or filler material, while taking into account the mass and location of the head portion. Players may prefer distributing the weight of lacrosse stick along its length and providing a balance point, or center of gravity, at a particular location.

Due to the strength of the materials, the composite constructions may also allow for a lighter weight structure, which may enable players to maneuver a stick faster to increase shot speed and avoid contact by opposing players. Lighter lacrosse sticks may also reduce player fatigue and allow lacrosse players to play longer and more effectively.

The composite constructions may also provide a smooth, minimal transition between the shaft portion and the head portion, which enables a player's hand to hold the lacrosse stick very close to the ball stop (especially when holding the stick with one hand), while still complying with widely-accepted rules governing the configuration and use of lacrosse heads (e.g., NCAA Men's Lacrosse 2019 and 2020 Rules, Rule 6, Section 12, prohibiting grasping any portion of the head and "thumbing" the ball). In contrast, with conventional lacrosse head constructions having separate plastic heads with large throats extending a considerable distance in the rearward direction, the rules prohibiting players from grasping any portion of the head cause players to grasp the separate handle at a grip position on the lacrosse stick that is much farther from the ball stop, thereby diminishing the player's feel and control of the lacrosse head and lacrosse ball.

In embodiments, the composite construction of a juncture-handle portion combined with the molded-material construction of a head portion may also provide critical performance characteristics in terms of stiffness, markedly improving over previous unsatisfactory attempts at full-composite one-piece lacrosse sticks, such as the HARROW HEMI™ and HARROW HEMI-CUDA™. Lacrosse players often found those previous one-piece lacrosse sticks to be too stiff in the lacrosse head, especially in the forward portion of the lacrosse head. Comparison stiffness testing conducted on previous one-piece lacrosse sticks and sample prototypes of embodiments of FIGS. 10-12 disclosed herein demonstrates more desirable flexibility in the sample prototypes. As shown in FIG. 18, the stiffness testing involved securing a lacrosse stick at the handle and applying a 10-pound force to one shoulder of the lacrosse head substantially perpendicular to the bisecting line of the lacrosse head, and then measuring the displacement of the shoulder. The photographs in FIG. 18 show a representative test setup for the Embodiment Sample #1 and the HARROW HEMI™. The Embodiment Samples #1 and #2 were both constructed in accordance with the embodiments of FIGS. 10-12. Each lacrosse stick was tested three times, with the average of the three trials noted in the rightmost column of Table 2 in FIG. 18. As a further reference point, a conventional lacrosse head (STX SURGEON 700™) was also tested, which was secured at its juncture without a handle and which was conditioned by first being saturated in water for 24 hours, to represent playing conditions.

As shown by the average displacement measurements in Table 2 of FIG. 18, the samples of embodiments disclosed herein provided displacements significantly higher than the previous one-piece lacrosse sticks, providing more flexible lacrosse heads, which lacrosse players prefer. As shown, the flexibility of the embodiment samples is on par with the flexibility of the STX SURGEON 700™ lacrosse head, which exhibits a flexibility widely preferred by lacrosse players. Moreover, if the embodiment samples were conditioned according to playing conditions, their flexibilities would be expected to be even closer to that of the STX SURGEON 700™ As further reference points, the plastic-only lacrosse heads, STX STALLION 700™ and NIKE VAPOR ELITE™, conditioned by 24-hour saturation in water, and under an applied 10 pound-force, have average displacements (average of 3 data points from same head/stick) of 1.140 inches and 1.090 inches, respectively. In embodiments disclosed herein, average displacements may range from about 0.7 inches to about 1.4 inches, under 10 pound-force. In addition to the measurements of Table 2, the difference in stiffness is readily apparent from the photographs of the testing. As shown in photograph 1 of FIG. 18, the lacrosse head of the Embodiment Sample #1 lacrosse stick significantly flexed and deformed due to the molded-plastic construction. In contrast, as shown in photograph 2 of FIG. 18, the lacrosse head of the HARROW HEMI™ lacrosse stick flexed almost imperceptibly due to the extreme stiffness throughout the head and handle portions.

Figure 33:
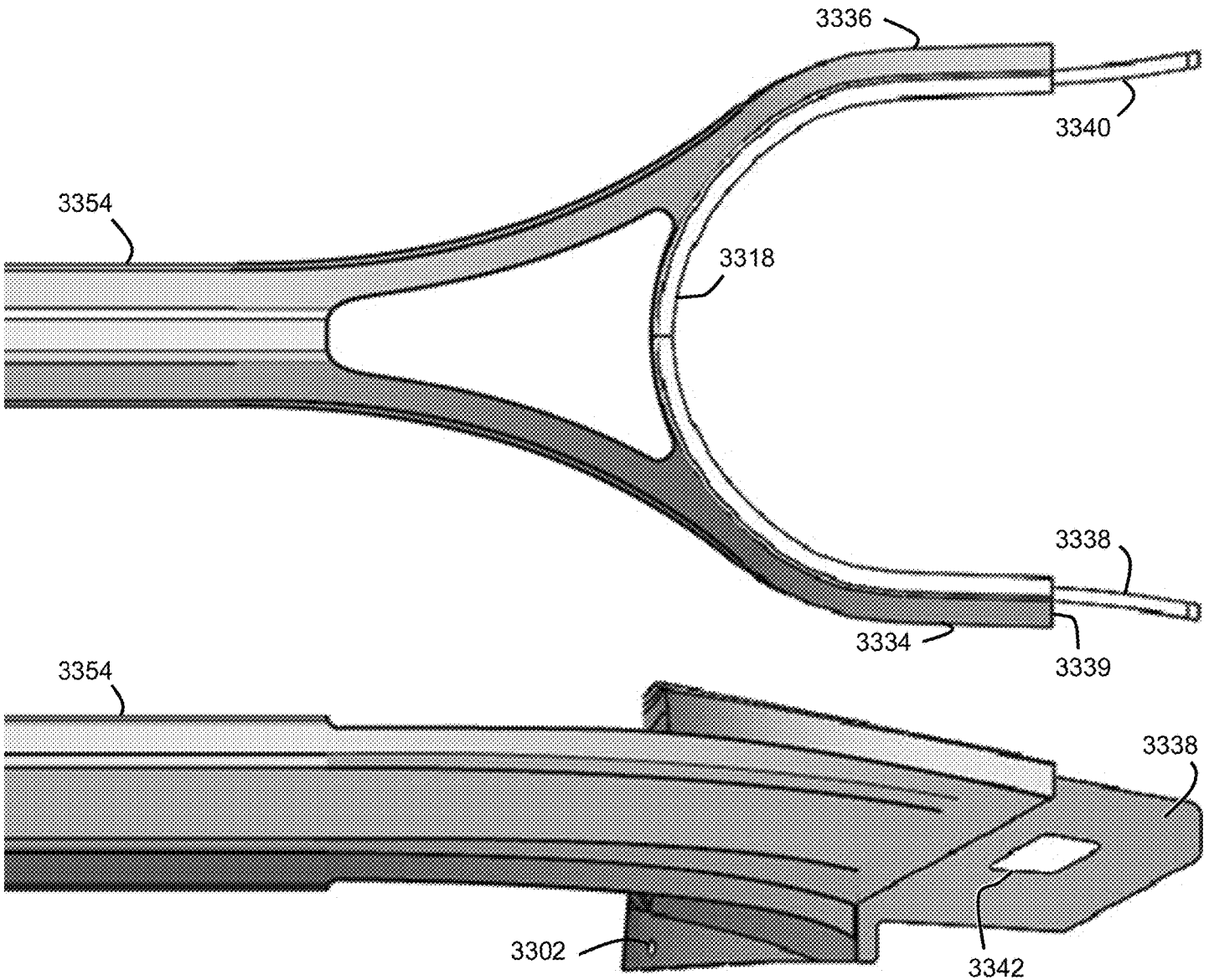
FIG. 33 is a schematic diagram that illustrates a top view and a side view of another embodiment of a juncture-handle portion, suitable for a women's lacrosse stick.

Although embodiments discussed above in reference to FIGS. 1-12, 19-23, and 25-30 may be intended for men's lacrosse sticks, the features described herein are applicable to any lacrosse sticks, including women's lacrosse sticks. For example, FIG. 33 illustrates a juncture-handle portion 3354 suitable for a women's lacrosse stick. As shown, the juncture-handle portion 3354 may have tabs 3338, 3340. The fork members of juncture-handle portion 3354 may define faces 3339 around the tabs 3338, 3340, and allow the moldable material of a head portion to flow around the tabs 3338, 3340 within a mold cavity, as described above in previous embodiments, to provide a strong, durable connection between the juncture-handle portion 3354 and the head portion. The tabs 3338, 3340 may also define openings 3342 for an additional mechanical connection, as described in the embodiments above. The stop member 3318 of juncture-handle portion 3354 may also define an opening 3302 through which molded material of a ball stop stringing member of a head portion (not shown) may be disposed to mechanically secure the ball stop stringing member to the stop member 3318.

As used herein, the "centerline" refers to the centerline of the majority of a handle. In the case of a straight handle, the centerline coincides with the center longitudinal axis of the straight handle. In instances of handles having angled end portions at lacrosse head frames, or in instances of angled throat sections of lacrosse heads, the centerline would be defined by the remaining majority length of the handle that extends away from the angled end portion or angled throat, and that is held by a player. For example, referring to FIGS. 2 and 3, if handle portion 130 bends within its last few inches (e.g., 3 inches) before throat member 132 at a 10-degree angle, then that bent end portion is to be ignored for purposes of the centerline. In the example of FIG. 2, the horizontal line 121, which corresponds to the majority length of the handle, is the centerline for purposes of the present embodiments.

As used herein, the term "sidewall rail" refers generally to the edge or surface of a sidewall running along the upper or lower portion of the sidewall. In this respect, a sidewall rail does not have to be a bar-like member as illustrated in open-sidewall embodiments described herein, and could instead be an integral member of a closed sidewall configuration, in which the upper edge of the closed sidewall can be considered an upper sidewall rail and the lower edge of the closed sidewall can be considered a lower sidewall rail. In addition, a sidewall rail could also be both bar-like and integral in a partially open sidewall configuration, for example, where the openings do not extend the full length of the sidewall, or in areas where a sidewall typically decreases in height and assumes a solid construction through the height, such as near the stop member or the transverse wall. Accordingly, notwithstanding the particular embodiments illustrated herein, the term "sidewall rail" should be broadly interpreted to cover any upper or lower edge or surface portion of a sidewall.

For purposes of convenience various directional adjectives are used in describing the embodiments. For example, the description may refer to the top, bottom, and side portions or surfaces of a component. It may be appreciated that these are only intended to be relative terms and, for example, the top and bottom portions may not always be aligned with vertical up and down directions depending on the orientation of a component or lacrosse stick.

It should also be noted that relative terms such as "upper," "lower," "top," and "bottom," are used herein to describe the embodiments as depicted in the accompanying figures and are not intended to be limiting. Unless the context of the usage dictates otherwise, when used in reference to a lacrosse stick or head as a whole, the term "front" refers to the side of the lacrosse stick through which a ball is caught and the terms "back" and "rear" refer to the side of the lacrosse stick that is opposite to the "front" and is where the pocket is disposed. It should also be noted that figures provided herein generally depict the illustrated lacrosse head with the pocket side of the head (i.e., the rear) facing downward. It will be apparent to skilled practitioners that the orientation of a lacrosse stick varies dramatically during play and the relative positions of the elements of the present embodiments will similarly vary from those depicted.

The foregoing disclosure of the preferred embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A lacrosse stick, comprising:

a juncture-handle portion including:

a throat member, a first fork member extending from the throat member in a forward direction, a second fork member extending from the throat member in the forward direction, a handle portion extending from the throat member in a rearward direction, and a first tab reinforcing member extending from the handle portion, through the throat member, and to the first fork member, and defining a first tab protruding beyond a distal forward end of the first fork member in the forward direction, wherein the throat member, the first fork member, the second fork member, and the handle portion are integrally formed of a first composite layup material, wherein the first tab reinforcing member is formed of a second composite layup material that is stiffer than the first composite layup material, wherein the first tab reinforcing member comprises a component separate from the integrally formed throat member, first fork member, second fork member, and handle portion, wherein the throat member, the first fork member, and the handle portion are integrally formed around the first tab reinforcing member such the first tab reinforcing member is enclosed within the handle portion, the throat member, and the first fork member until emerging from the first fork member to define the first tab, and wherein the first tab defines an opening that extends through the first tab in a direction lateral to the forward direction; and a head portion made of a molded material and including:

a first sidewall portion molded over the first tab of the first tab reinforcing member and extending from the first fork member in the forward direction, wherein the molded material of the head portion is disposed inside the opening of the first tab to provide a mechanical first connection between the head portion and the juncture-handle portion, a second sidewall portion extending from the second fork member in the forward direction, and a transverse wall portion connecting the first sidewall portion and the second sidewall portion opposite to the juncture-handle portion, wherein the head portion is more flexible than the juncture-handle portion.

2. The lacrosse stick of claim 1, wherein the first composite layup material comprises unidirectional carbon and fiberglass material, the second composite layup material comprises fiberglass plies, and the molded material comprises plastic.

3. The lacrosse stick of claim 1, wherein the juncture-handle portion includes a second tab reinforcing member extending from the handle portion, through the throat member, and to the second fork member, and defining a second tab protruding beyond a distal forward end of the second fork member in the forward direction, wherein the second tab reinforcing member is formed of the second composite layup material, wherein the second tab reinforcing member comprises a component separate from the integrally formed throat member, first fork member, second fork member, and handle portion, wherein the throat member, the second fork member, and the handle portion are integrally formed around the second tab reinforcing member such the first tab reinforcing member is enclosed within the handle portion, the throat member, and the second fork member until emerging from the second fork member to define the second tab, wherein the second tab defines an opening that extends through the second tab in a direction lateral to the forward direction, wherein the second sidewall portion is molded over the second tab of the second tab reinforcing member, and wherein the molded material of the head portion is disposed inside the opening of the second tab to provide a mechanical second connection between the head portion and the juncture-handle portion.

4. The lacrosse stick of claim 1, further comprising a shaft portion that is disposed on a side of the handle portion opposite to the throat member, and is integrally formed of the first composite layup material along with the throat member, the first fork member, the second fork member, and the handle portion.

5. The lacrosse stick of claim 1, further comprising a shaft that is mechanically and/or chemically connected to the handle portion of the juncture-handle portion.

6. The lacrosse stick of claim 1, wherein the throat member, the first fork member, the first sidewall portion, the transverse wall portion, the second sidewall portion, and the second fork member form a pocket frame having a front side and a back side, wherein the throat member defines a ball stop member, wherein the head portion further comprises a ball stop stringing member that connects the first sidewall portion and the second sidewall portion and is molded to a back side of the ball stop member, and wherein the ball stop stringing member defines a stringing opening.

7. The lacrosse stick of claim 6, wherein the first tab reinforcing member extends enclosed within the throat member in a direction toward the back side of the pocket frame and emerges from the ball stop member of the throat member to define a second tab protruding from the back side of the ball stop member of the throat member, and wherein the ball stop stringing member of the head portion is molded over the second tab of the first tab reinforcing member.

8. The lacrosse stick of claim 1, wherein the first fork member has a first height in a front-to-back direction and a first width perpendicular to the first height, wherein the first fork member defines a first contact surface that is lateral to a longitudinal direction in which the first fork member extends, wherein the first tab has a second width less than the first width and protrudes from the first contact surface, wherein the first sidewall portion of the head portion defines a second contact surface that is lateral to a longitudinal direction in which the first sidewall portion extends, and wherein the first contact surface contacts the second contact surface.

9. The lacrosse stick of claim 8, wherein, when the lacrosse stick is viewed from a side elevation view with a front face of the head portion facing up, the first contact surface contacts the second contact surface along a substantially linear seam extending from an uppermost point of the seam downwardly and rearwardly at a seam angle, and wherein the seam angle is within a range of about 20 degrees to about 70 degrees, relative to a horizontal centerline of a majority handle length of the lacrosse stick.

10. The lacrosse stick of claim 1, wherein the throat member comprises:

a composite layup ball stop wall; and a filler material disposed between the first tab reinforcing member and the composite layup ball stop wall.

11. The lacrosse stick of claim 10, wherein the filler material comprises an epoxy.

12. The lacrosse stick of claim 1, wherein the opening of the first tab is circular and the molded material of the head portion defines a post that spans a width of the first tab.

13. The lacrosse stick of claim 1, wherein the distal forward end of the first fork member defines a raised edge that protrudes from a surface of the first tab and defines a first portion of an interlocking second connection between the head portion and the juncture-handle portion, wherein the molded material of the head portion is disposed adjacent to the raised edge and defines a second portion of the interlocking second connection, and wherein the first portion of the interlocking second connection is interlocked with the second portion of the interlocking second connection.

14. The lacrosse stick of claim 13, wherein the raised edge defines between the juncture-handle portion and the head portion a seam that is visible on an outer face and/or an inside pocket-facing face of the lacrosse stick.

15. The lacrosse stick of claim 13, wherein the molded material of the head portion overlaps the raised edge and contacts an outer surface of the first fork member.

16. A method for making a lacrosse stick, comprising:

laying up composite material to form a handle portion having a rearward end portion and a forward end portion;

attaching a first ply stackup to a first side of the forward end portion of the handle portion and a second ply stackup to a second side of the forward end portion of the handle portion, wherein the first and second ply stackups are stiffer than the first composite material layup, and wherein the first ply stackup provides a first tab reinforcing member and the second ply stackup provides a second tab reinforcing member;

further laying up the composite material around the first and second ply stackups to further form the handle portion and to form a stop member, a juncture, a first fork member, and a second fork member, wherein the first ply stackup defines a first tab of the first tab reinforcing member protruding from the first fork member in a forward direction away from the handle portion and the second ply stackup defines a second tab of the second tab reinforcing member protruding from the second fork member in the forward direction, wherein the first tab reinforcing member of the first ply stackup extends from, and is enclosed within, the handle portion, the juncture, and the first fork member until protruding from the first fork member to define the first tab, wherein the second tab reinforcing member of the second ply stackup extends from, and is enclosed within, the handle portion, the juncture, and the second fork member until protruding from the second fork member to define the second tab, wherein the first tab defines a first opening that extends through the first tab in a direction lateral to the forward direction, and wherein the second tab defines a second opening that extends through the second tab in a direction lateral to the forward direction;

applying heat and pressure to the composite material layups to integrally form the handle portion, the stop member, the juncture, the first fork member, and the second fork member into a juncture-handle portion around the first and second ply stackups, wherein the first tab reinforcing member of the first ply stackup and the second tab reinforcing member of the second ply stackup are components separate from the integrally formed handle portion, stop member, juncture, first fork member, and second fork member;

placing the juncture-handle portion in a mold that defines a cavity corresponding to a head portion of the lacrosse stick, wherein the cavity encloses the first tab and the second tab;

placing moldable material into the cavity to form the head portion, wherein the moldable material flows around and attaches to the first tab and the second tab, wherein the molded material of the head portion is disposed inside the first opening of the first tab and the second opening of the second tab to provide a mechanical connection between the head portion and the juncture-handle portion; and removing the attached head portion and juncture-handle portion from the mold.

17. The method of claim 16, wherein before applying heat and pressure, the method further comprises adding filler material within the second composite material layup to adjust a balance of the lacrosse stick.

18. The method of claim 16, wherein the cavity defines a ball stop stringing member of the head portion of the lacrosse stick over a back side of the stop member, and wherein the moldable material attaches to the back side of the stop member.

19. The method of claim 16, wherein the composite material comprises unidirectional carbon and fiberglass material, the first and second ply stackups comprise fiberglass plies, and the moldable material comprises plastic.

* * * * *